US012582227B2

(12) United States Patent
Gonzalez

(10) Patent No.: US 12,582,227 B2
(45) Date of Patent: Mar. 24, 2026

(54) SAMPLE RANDOMIZER FOR BLIND TESTING

(71) Applicant: LIBATION AFICIONADO, LLC., Lutz, FL (US)

(72) Inventor: Bryan Gonzalez, Lutz, FL (US)

(73) Assignee: LIBATION AFICIONADO LLC, Lutz, FL (US)

( * ) Notice: Subject to any disclaimer, the term of this patent is extended or adjusted under 35 U.S.C. 154(b) by 0 days.

(21) Appl. No.: 19/087,171

(22) Filed: Mar. 21, 2025

(65) Prior Publication Data

US 2025/0338955 A1 Nov. 6, 2025

Related U.S. Application Data

(60) Provisional application No. 63/642,121, filed on May 3, 2024.

(51) Int. Cl.
*A47B 31/00* (2006.01)
*A47B 49/00* (2006.01)

(52) U.S. Cl.
CPC ..... *A47B 31/00* (2013.01); *A47B 49/008* (2013.01)

(58) Field of Classification Search
CPC ..... A47B 31/00; A47B 49/008; A47F 3/10; A47F 3/11; A47F 5/02; A47F 5/025; A63F 9/00
See application file for complete search history.

(56) References Cited

U.S. PATENT DOCUMENTS 168,448 A * 10/1875 Butterfield et al. . A47B 49/004 312/285
984,479 A * 2/1911 Griswold et al. .... A47B 49/004 312/249.8
1,295,232 A * 2/1919 Stewart ..... A47F 3/10 312/72
1,471,594 A * 10/1923 Evans ..... A47B 49/004 211/74

(Continued)

FOREIGN PATENT DOCUMENTS

CN 202077825 U 12/2011
CN 202887249 U 4/2013

(Continued)

*Primary Examiner* — Stanton L Krycinski
(74) *Attorney, Agent, or Firm* — The Concept Law Group, PA; Scott D. Smiley; Scott M. Garrett

(57) ABSTRACT

A sample randomizer allows a user to have a set of samples from a corresponding set of sources to be physically randomized so that the user does not know which sample came from which source. The sample randomizer keeps track of the samples so that the source of each sample can be revealed after testing the samples. A covered rotating table is used to physically randomize the samples. Each sample is individually loaded into the table in a given sample position. The other sample positions are obscured from view so that the user cannot see if there is a sample in the adjacent sample positions. The order of the sample and their corresponding sources are tracked, and the samples are dispensed from the table in a random order that is also tracked. The user can then test the samples, placing them in ranking positions of a ranking station of the device. When the user is done testing the samples, the sample randomizer can then indicate the source of each sample at each ranking position.

7 Claims, 13 Drawing Sheets

(56) References Cited

U.S. PATENT DOCUMENTS 2,740,684 A * 4/1956 Haralson ..... A47B 49/004 312/234.2
3,023,908 A * 3/1962 Ramey ..... A47F 5/02 211/74
3,807,826 A * 4/1974 Peckenpaugh ..... A47B 49/004 312/305
4,632,474 A * 12/1986 Ingersoll ..... A47B 49/004 312/305
4,972,947 A * 11/1990 McCarthy ..... B43M 99/006 206/214
5,076,444 A * 12/1991 Syms ..... A47F 3/10 211/163
5,651,595 A * 7/1997 Willis ..... G11B 33/0438 312/285
5,921,394 A * 7/1999 Shroff ..... B65D 83/0454 206/533
6,609,773 B1 * 8/2003 Steadman ..... A47B 49/00 312/298
7,395,945 B2 * 7/2008 Godlewski ..... A47B 49/004 221/121
7,963,407 B2 * 6/2011 Donnellan ..... A47B 49/00 211/70
8,244,398 B2 * 8/2012 Rivenbark, Jr. ..... G07F 11/16 700/214
9,615,660 B2 * 4/2017 Hogeback ..... A47B 49/004
10,779,644 B2 * 9/2020 Vanderwert ..... A47B 49/004
10,932,592 B2 * 3/2021 Godbole ..... A47F 3/11
2004/0177641 A1 * 9/2004 Kim ..... F25D 25/027 62/381
2006/0154728 A1 * 7/2006 Plummer ..... A63F 11/0011 463/21
2014/0252924 A1 * 9/2014 Miller ..... A47F 10/00 312/202
2018/0146804 A1 * 5/2018 Travisono ..... F16B 2/22

FOREIGN PATENT DOCUMENTS

CN 107432557 A 12/2017
CN 207520064 U 6/2018
CN 213487610 U 6/2021
CN 113397306 A 9/2021
DE 102013005935 A1 * 10/2013 ..... A47F 3/10
EP 0276339 A1 * 8/1988 ..... A47B 96/16
FR 1323924 A * 4/1963
FR 1512539 A * 2/1968
FR 2116795 A5 * 7/1972
GB 2501880 A * 11/2013 ..... A47F 3/04

* cited by examiner

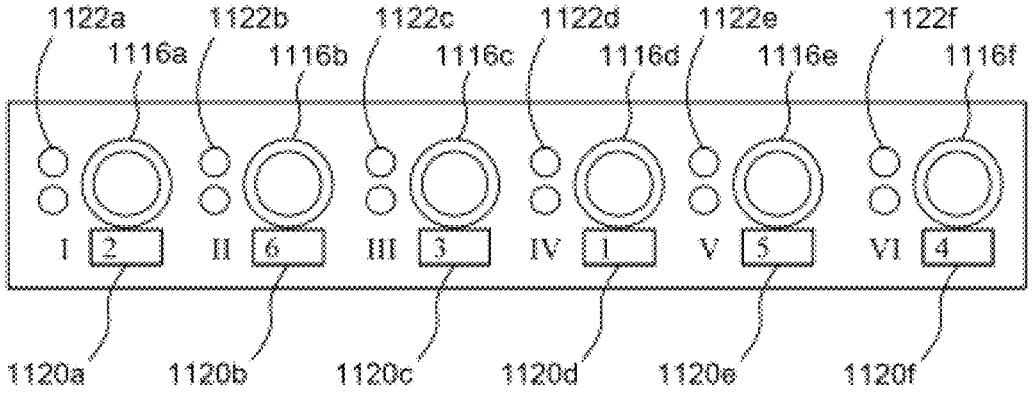
FIG.12A
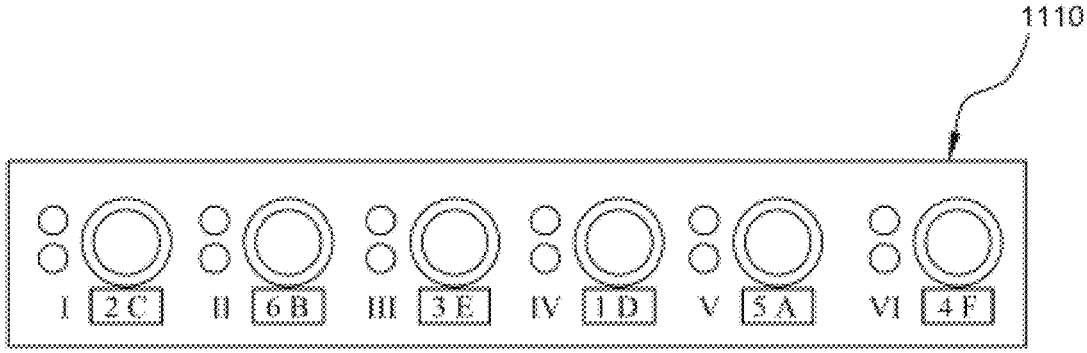
FIG.12B
| SOURCE | A | B | C | D | E | F |
|---|---|---|---|---|---|---|
| TABLE POSITION | 1 | 2 | 3 | 4 | 5 | 6 |
| DISPENSED POSITION | V | II | I | IV | III | VI |
FIG.12C

| SOURCE | A | B | C | D | E | F |
|---|---|---|---|---|---|---|
| TABLE POSITION | 1 | 2 | 3 | 4 | 5 | 6 |
| DISPENSED POSITION | V | II | I | IV | III | VI |

SAMPLE RANDOMIZER FOR BLIND TESTING

CROSS-REFERENCE TO RELATED APPLICATION

This application claims priority to U.S. Provisional Patent Application No. 63/642,121, filed May 3, 2024, the entirety of which is incorporated by reference.

FIELD OF THE INVENTION

The present invention relates generally to devices and apparatuses used for blind testing, such as taste testing, and, more particularly, relates to a method, system, and device that allows an individual user to select several samples for comparison, and randomize them blindly from the user so that the user does not know which sample the user is then subsequently testing. This eliminates the need to have another individual randomize the samples.

BACKGROUND OF THE INVENTION

There are many instances in which human perception and preference are tested in blind tests. This means that the person performing the test does not have information about any of the particular samples being tested. For example, it is common for wine and liquor to be blindly tasted by people for contests, or for their own personal enjoyment. These tests rely on having someone set up the samples so that the person or persons performing the testing do not know the origin/brand/makeup or other information that could be used to identify the samples, and maintain a record of such information for each sample so that at the end of the testing the sample information for each sample can be revealed, and the results of the testing then known. But if, for example, a person wanted to perform a blind tasting of samples of their own collection, and does not have another person to prepare and track the samples, then they have not been able to do so. This may be done simply as a hobby, or it can be part of a formal educational process to study, for example, wines, spirits, or other consumables. In the past, and presently, studying to become a sommelier or obtain a similar education for other types of consumables requires in-person attendance due to the need to conduct blind tastings and to demonstrate a learned understanding of subject matter (e.g. being tested for proficiency). This limits the ability for people interested in endeavors to obtain the necessary training and certification.

Therefore, a need exists to overcome the problems with the prior art as discussed above.

SUMMARY OF THE INVENTION

In accordance with some embodiments of the inventive disclosure, there is provided a sample randomizer that includes a base and a table positioned in the base that is rotatable. The table includes a plurality of defined sample positions in which a plurality of sample containers can be placed. There is also a cover that is configured to fit onto the base and conceal the table. The cover includes a door that is configured to expose a single one of the defined sample positions on the table when opened. There is also a controller that is coupled to a memory. The sample randomizer is loaded by placing the sample containers into the sample positions of the table, one at a time, opening and closing the door each time a sample container is placed into a sample position of the table. Each sample container can contain a sample of one of a plurality of sources. Each source of the plurality of sources is associated with a unique identifier. The sample containers are loaded into table in a known order. For example, if the unique identifiers used to identify the sources are A-F, then the source containers are loaded in that order, with the source container containing the sample of source A being loaded first, then the source container containing the sample of source B, and so on, serially. Upon being loaded with the plurality of sample containers, the plurality of sample containers are then dispensed in a randomized order selected by the controller. The order can be randomized when loading or dispensing, or both. To randomize the order when loading, the table position for each sample container can be randomly selected, and the table rotated so that the randomly selected table position is presented at the door. To randomize when dispensing, the table position (which holds a sample container) is randomly selected, and then the table is rotated so that the randomly selected table position is presented at the door, allowing the user to remove the sample container, having no knowledge as to which source sample is container in the sample container. To keep track of which source sample is in each of the dispensed sample container, a memory, coupled to the controller, is used to create a mapping of a source of each one of the plurality of sample containers to the randomized order in which the plurality of sample containers are dispensed. The sample randomizer also includes a ranking station that has a plurality of ranking positions. Each one of the plurality of sample containers are placed in one of the ranking positions upon being dispensed. Each ranking position has at least one input button and a display. At each ranking position there is at least one input button is configured to receive a user input indicating one of a ranking or an identity. The display is configured to display the user input and the source corresponding to the sample container based on the mapping, when the user has tested all of the samples and entered their input for each sample at each ranking position.

In accordance with a further feature, there is also a separator wall that sits on the table and separates the plurality of sample positions from each other, and which is covered by the cover when the cover is placed over the table.

In accordance with a further feature, there is also a main display that is positioned at a front of the sample randomizer and which is configured as a touch screen.

In accordance with a further feature, the table has six defined sample positions.

In accordance with a further feature, the mapping maps a plurality of sets of sources for a respective plurality of users.

In accordance with a further feature, there is also a door sensor that indicates whether the door is open or closed.

In accordance with a further feature, there is also a network connector to operably connect the controller to a remote server.

In accordance with some embodiments of the inventive disclosure, there is provided a method of operating a sample randomizer. The method includes providing, by a sample randomizer, a table defining a plurality of sample positions, and a cover that is configured to sit over and conceal the table and any sample containers loaded into the sample positions. The cover has a door that is configured to expose only one sample position when opened. The table is rotatable so that it can rotate to present each one of the sample positions at the door. The method further includes prompting a user to load a plurality of sample containers onto the table, in a serial manner. The loading includes opening and closing the door for loading each sample container, and the sample containers are loaded in a known order. The "known order" can be a prescribed order (e.g. samples from sources A-F, in that order), or the sample randomizer can include means to identify each one of the sample containers, such as a bar code reader or RFID reader that reads a corresponding bar code or RFID element of the sample containers. The method also includes creating, in a memory of the sample randomizer, a mapping record in which each sample container is assigned an identifier that is associated with a position in which the sample container was loaded into the table, the method further includes dispensing, in a randomized order, by rotating the table, the sample containers, wherein each sample container is removed from the table in a serial manner (meaning one at a time). The method also includes updating the mapping record during the dispensing such that each identifier is mapped to an order position in which the sample container was dispensed. The method further includes receiving, at the sample randomizer from user, an input for each sample container, after the plurality of sample containers have all been dispensed, indicating one of either a ranking or an identity to be associated with the sample container (the user's guess as to which source the sample in that sample container came from). The method also includes indicating, based on the mapping record, the assigned identifier for each sample container in association with a dispensed order position of each sample container.

In accordance with a further feature, the sample randomizer is further provided with a ranking platform that includes plurality of ranking stations, each one of the plurality of ranking stations including a button for indicating a selection, receiving the input for each sample container of the plurality of sample containers comprises receiving the input for each ranking station at the button corresponding to the ranking station.

In accordance with a further feature, the sample randomizer is further provided with a ranking platform that includes plurality of ranking stations, each one of the plurality of ranking stations including a display element, indicating the assigned identifier comprises displaying the assigned identifier for each dispensed sample container at the display element corresponding to the ranking station at which the sample container is placed.

In accordance with a further feature, creating the mapping record comprises creating a mapping record for a plurality of users by creating a plurality of subsets in the mapping record in which each subset of the plurality of subsets corresponds respectively to one user of the plurality of users.

In accordance with a further feature, updating the mapping record comprises mapping each identifier is repeated for each subset in the mapping record.

In accordance with some embodiments of the inventive disclosure, there is provided a method that includes providing a sample randomizer including a rotatable table defining a plurality of sample positions. There is also a cover that is configured to sit over and conceal the rotatable table and any sample containers loaded into the sample positions. The cover has a door configured to expose only one sample position when opened. There is also a controller, and a memory coupled to the controller. There is also a ranking station including a plurality of ranking positions corresponding to the plurality of sample positions. The method further includes assigning, to each of a plurality of sources, a unique identifier of a respective plurality of unique identifiers. The method also includes dispensing, from each source of the plurality of sources, a sample of each source into a respective sample container of a plurality of sample containers. The method also includes loading the sample containers into the sample positions of the rotatable table, in a serial manner. The method further includes, in conjunction with loading the sample containers, creating a mapping record in the memory which maps the unique identifier of each source to the sample position in which the sample container containing the sample from the source was loaded based on an order of loading the sample containers. The method also includes dispensing, from the rotatable table, in a randomized order, the plurality of sample containers, in a serial manner. The rotatable table is rotated to align each table position with the door in a random order. The method further includes, in conjunction with dispensing the plurality of sample containers, updating the mapping record to include a dispensing order indicator indicating a position in which each of the sample containers were dispensed. The method also includes, as the sample containers are each dispensed, placing the sample containers in the ranking positions in the order in which they are dispensed. The method further includes receiving at each ranking position, a user input indicating one of a ranking or an identifier corresponding to one of the plurality of unique identifiers. The method also includes, responsive to a final user input, indicating at each ranking position the unique identifier associated with the sample container at the ranking position based on the mapping record.

Although the invention is illustrated and described herein as embodied in a sample randomizer for blind testing, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down," "left," "right," "inside," "outside," "front," "back," "head," "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first," "second," "third," and so on are only used for descriptive purposes and cannot be construed as indicating or implying relative importance.

In the description of the embodiments of the present invention, it should be noted that, unless otherwise clearly defined and limited, terms such as "installed," "coupled," "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances, these terms may include numbers that are rounded to the nearest significant figure. In this document, the term "longitudinal" should be understood to mean in a direction corresponding to an elongated direction of the article being references. To the extent that any software or computer instruction code is references, the terms "program," "software application," and the like as used herein, are defined as a sequence of instructions designed for execution on a computer system. A "program," "computer program," or "software application" may include a subroutine, a function, a procedure, an object method, an object implementation, an executable application, an applet, a servlet, a source code, an object code, a shared library/dynamic load library and/or other sequences of instructions designed for execution on a computer system. Those skilled in the art can understand the specific meanings of the above-mentioned terms in the embodiments of the present invention according to the specific circumstances.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

FIG. 12A shows a user ranking of randomized samples placed in the ranking station of a sample randomizer, in accordance with some embodiments.

FIG. 12B show a source reveal of randomized samples placed in the ranking station of a sample randomizer, in accordance with some embodiments.

FIG. 12C shows a memory table data structure used by a sample randomizer to track which source sample was dispensed to each respective tasting position of the sample randomizer, in accordance with some embodiments.

DETAILED DESCRIPTION

Figure 1:
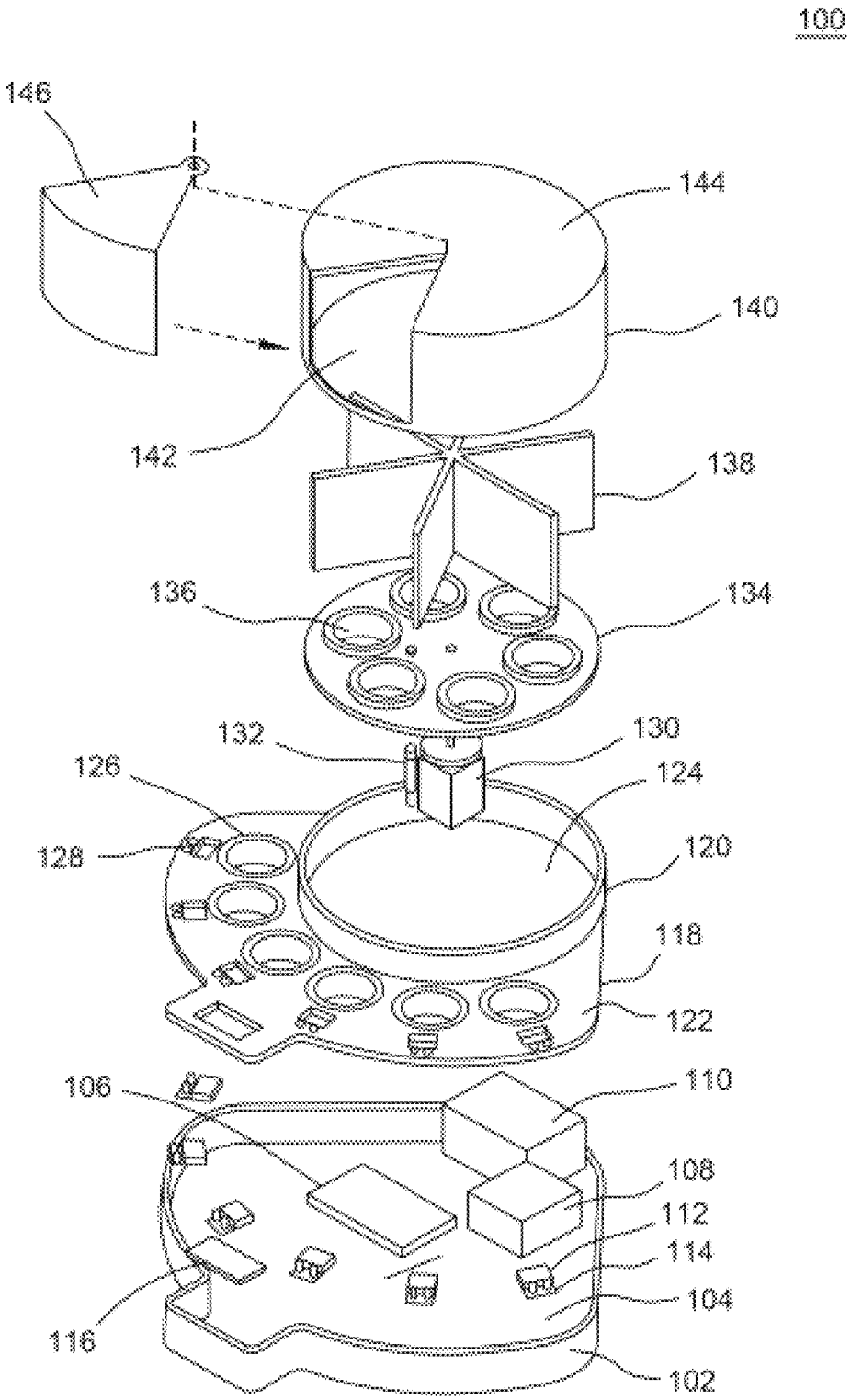
FIG. 1 shows an exploded view of a sample randomizer for blind testing, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The inventive sample randomizer disclosed and claimed herein allows a person, or a small number of people, to randomize a group or groups of samples and then dispense the samples such that the person or people do not know the order in which samples are dispensed, and therefore are "blind" as to which sample is in a given dispensed sample container. The inventive sample randomizer eliminates the need for a person, who is not participating in the sample testing, to randomize the samples for the person or people performing the sample testing. Although there are numerous applications for the disclosed sample randomizer, perhaps the most relatable example is in using the sample randomizer for blind taste testing of libations-wine, spirits, beer, etc. Such taste testing is a popular endeavor for hobbyists who want to sharpen their senses and their palate, but it can also be used for more formal training, such as in the pursuit of certifications in sommelier training. The disclosed sample randomizer is inventive in how it is constructed, how it operates, and in the numerous applications for which it can be used.

Figure 2:
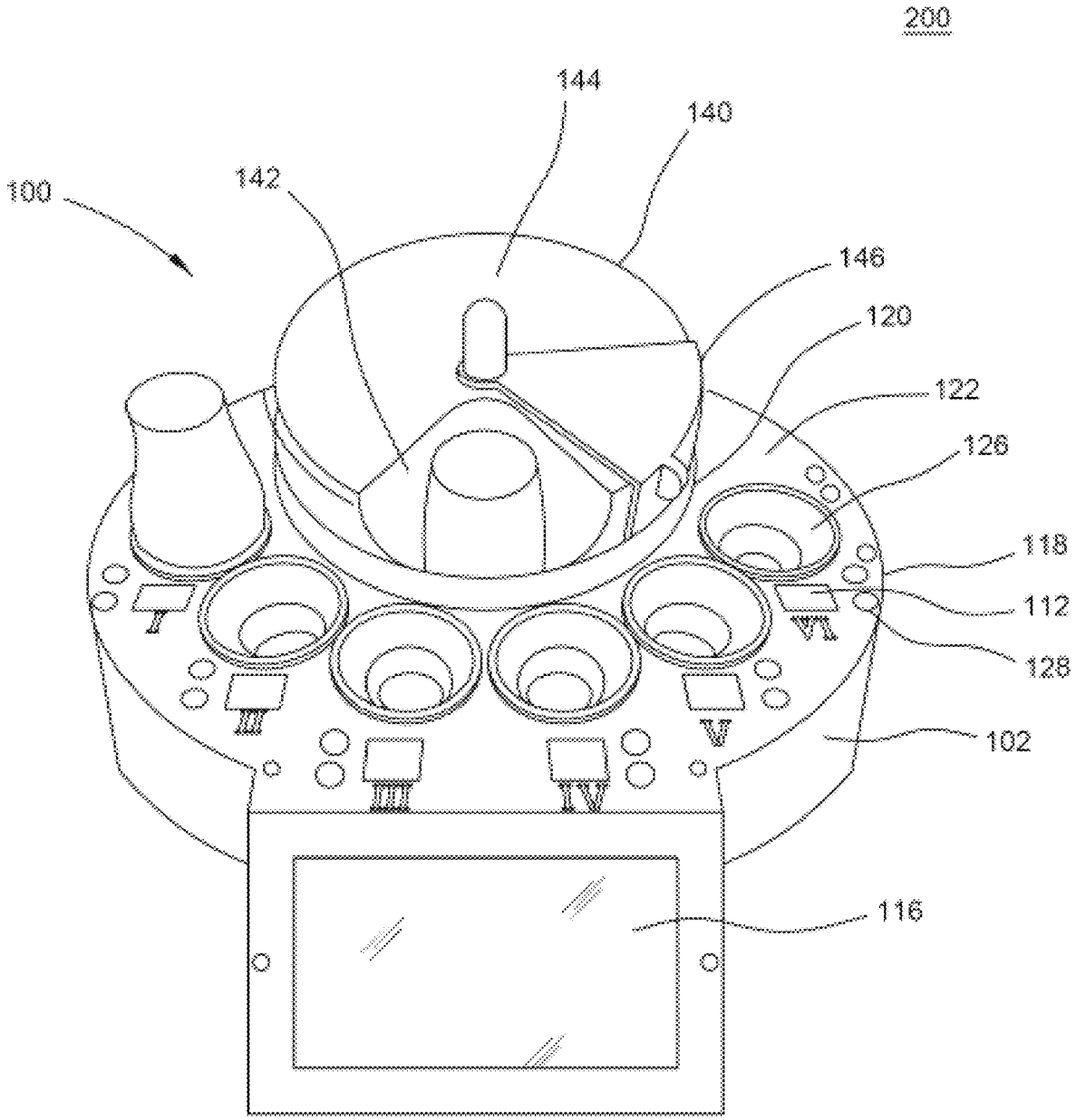
FIG. 2 shows a front perspective view of a sample randomizer for blind testing, in accordance with some embodiments.

FIG. 1 shows an exploded view of a sample randomizer 100 for blind testing, in accordance with some embodiments. Reference can also be made to FIG. 2, which shows a front perspective view of a sample randomizer 100. The sample randomizer 100 includes a base housing 102 in which that is an interior volume 104. Disposed in the interior volume 104 is a control unit 106 that can include a processor for carrying out instruction code and which is interfaced to the other system components to control and operate them in accordance with instruction code being executed by the processor. For example, the control unit 106 can be operably connected to a stepper motor 108, as well as various input/output components such as, for example, individual LED segment displays 112, button 114, and a main graphic display 116. A power supply 110 converts an alternating current (AC) supply to useable direct current (DC) outputs to power the various components of the sample randomizer.

On top of the base housing 102 there can be a deck 118 that provides a ranking station on the deck surface 122. The ranking station can include individual sample container holders 126 at each of several ranking positions. The holders 126 are configured to receive a sample container that can include an identifier, and the holders 126 each have a reader that can read the identifier of the sample container placed into the holder 126. For example, each sample container can include a radio frequency identifier (RFID) that is response to a reader signal from an RFID reader in the holder 126 (one reader located in each holder 126). In some embodiments an optical identifier, such as a QR code, can be used, and each holder 126 can include an optical scanner to read the QR code on the sample container placed into the respective holder 126. The deck 118 can also include openings 128 for the LED segment display 112 and buttons 114. The segment displays 112 are configured to display the user input (selection) and the source corresponding to the sample container placed at the respective holder, based on a mapping record. For example, if the user believes the sample at ranking position III is from sample A, the user can press one of the buttons 128 as the identifiers are displayed on the display element 112, cycling thought the source identifiers with each button push until the user's selection appears. At the end of the process, the actual source can be displayed at the display element next to the user's selection. Further, the deck 118 can include a circular cowl 120 that defines a table region 124. The cowl 120 is a short wall that extends upward from the top surface 122 of the deck 118.

A randomizing table 134 is configured to sit within the cowl 120, or on top of the cowl 120, and is itself circular. The randomizing table 134 defines a plurality of stations 136, which are each defined sample positions, and that are each configured to receive and hold a respective sample container during the overall randomizing process. The stations 136 are organized in a circular pattern around the randomizing table 134. A stepper motor 130 is coupled to the randomizing table 134 to turn the randomizing table during the general randomizing operations (including initial loading and dispensing of samples). A homing device 132 can be used to track the position of the randomizing table 134 and ensure that the randomizing table is correctly positioned during use. A divider or separator wall 138 includes a plurality of walls that separate the holder 136 from each other. The walls of the divider 138 block a user from seeing any samples/sample container is the adjacent holder when loading sample containers into, and dispensing sample containers from the sample randomizer. The divider 138 can be removably attached to the table 134. Each of the walls of the divider 138 extend upwards from the surface of the table 134 and also extend radially from the center of the table 134. To further conceal the samples placed in the holders 136, a cover 140 is placed over the table 134 and divider 138. The cover 140 can be substantially cylindrical, and have a top surface 144 and an opening 142. The opening 142 can be wedge-shaped and open at the top surface 144 to allow sample containers to be easily placed into and removed from its holder 136 on the table 134. A door 146 can be used to cover the opening 142 during certain operations of the randomizing process. The door 146 can include a wedge-shaped top section, and an arcuate wall section that is configured to be coaxial relative to the center of the table 134 and the outside wall of the cover 140. The door 146 can be moved to the side, rotating about the center of the cover 140 along the outer wall of the cover 140. In some embodiments there can be a door sensor disposed in the cover 140, or elsewhere equivalently, that allows the sample randomizer 100 to determine if the door 146 is open or closed. The door 146 is sized so that only one sample position is exposed when the door 146 is open.

Briefly, in operation, a user can operate the sample randomizer to input a number of samples to be tested, from two to the total number of holders 136 (which match the number of holders 126 on the deck 118). Alternatively, if multiple people want to engage in the testing, then a user can indicate the number of people, and the number of samples each person will test. In the exemplary sample randomizer 100, one person can test two to six samples. Two people can each test two to three samples, and three people can each test two samples. The samples are prepared by pouring an amount of each sample from a source container into one of the sample containers. Each sample container has a unique identifier (e.g. RFID, QR code, etc.). The sample containers are then placed into the holders 126 on deck. The sample randomizer 100 then reads the identifier of each sample container. The process for doing this can be guided by, for example, text displayed on the main screen 116. This allows the sample randomizer to associate a sample container identifier with a source. For example, a sample from source A is placed into a sample container that is then placed into the first holder 126 (the holders can be marked with station numbers I, II, III, IV, V, VI as in FIG. 2), and the identifier of the sample container is then read and associated in a memory of the sample randomizer with source A. Then additional samples from the other sources can be placed in the other holders 126. A single person performing a test can test up to six samples in the present exemplary sample randomizer. Two people can test, for example, sources A, B, and C, each by placing a sample from source A in each of location I and IV, a sample from source B in locations II and V, and a sample from source C in location III and VI. Thus, the first person can test the samples initially in locations I-III, and the second person can test the samples initially in locations IV-VI. Once the sample containers are properly associated with the respective sources, the sample container can be loaded into the holder 136 in the randomizing table. The sample randomizer then associates the sample identifier with the respective holder 136 among the several holders in the table 134. The door 146 is then closed, and the sample randomizer then selects an available holder 136, and turns the table 134 until that holder is positioned at the door opening 142. Guided by a prompt from the sample randomizer (e.g. at the display 116 or some equivalent indicator), the user then opens the door 146 and places the next sample container into the exposed holder. This process is repeated until all of the samples are loaded into the table 134. The sample randomizer at that point has created a memory record indicating which sample container is located in each holder 136 of the table 134, and which sample source is held in each sample container, and in cases in which there are multiple testers, which tester is associated with the sample.

Once the table 134 is loaded, the samples can be dispensed for testing. At this point, the user would not know where any of the samples are located, so they could be dispensed in order, or the dispensing process can be randomized as well. The user can be guided by prompts from the sample randomizer to open the door, remove the exposed sample container, and then test the sample. Once the samples have been dispensed and tested, the user or users can then place the sample containers in the holders 126 for ranking, where the source of each sample is then disclosed to the user. In this way a user can determine their own personal preferences of the tested sources, or the user can attempt to identify the samples and match them to a source, in which case the sample randomizer can indicate which samples were correctly identified by the person or people performing the testing.

Figure 3:
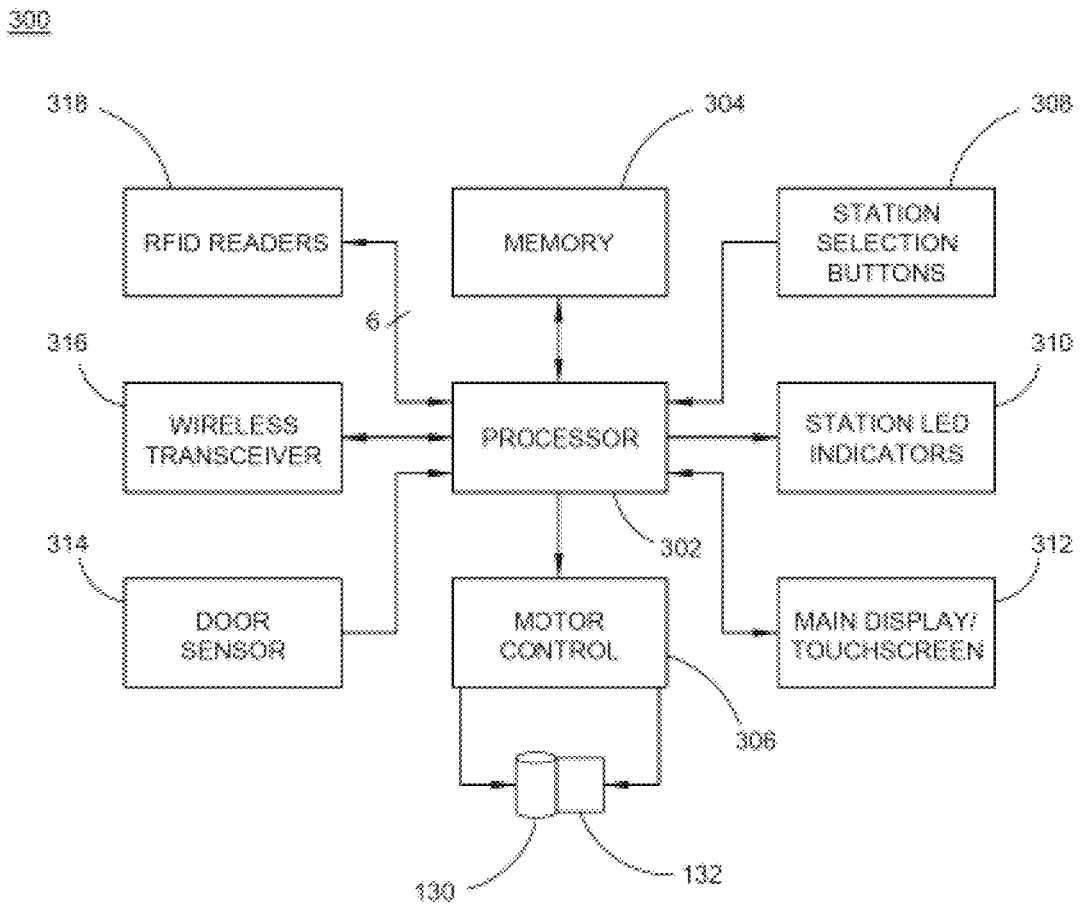
FIG. 3 shows a block schematic diagram of a sample randomizer for blind testing, in accordance with some embodiments.

FIG. 3 shows a block schematic diagram 300 of a sample randomizer for blind testing, in accordance with some embodiments. The block schematic diagram 300 represents some of the electrical or electronic components of the sample randomizer, such as sample randomizer 100, and indicates their functionality in operating the sample randomizer. The main component is a processor 302 that is operable to perform instruction code consistent with the functions described herein. The processor 302 can be a conventional microprocessor including cache memory, registers, input and output ports, a logic unit, and so on, as is well known. The processor 302 is interface with memory 304, which can represent several types of memory including non-volatile memory for storage of instruction code and long-term variables, records of test results and other data that needs to be persistent through power cycles. The memory 304 can also include random access memory for instantiation and execution of instruction code, and short-term storage of operating data and data structures. The processor can be operably coupled to a motor controller 306, which operates a stepper motor 130 and homing device 132 as previously described. The stepper motor is calibrated to the randomizing table, and the positions of the holders (136) on the table so that the processor can command the motor controller to rotate the table to move a selected one of the holders 136 to the door position.

The sample randomizer include several input and output components, including station selection buttons 308 that can be located at each station to enter selection choices. There can be a display unit, such as LED indicators 310 at each station (e.g. each holder 126). And there can be a main display 312 that can also be a touch screen for input. The main display can present menus for operations, and allow a user to select and configure a testing regimen. To facilitate randomizations, there can be a door sensor 314 that is used to sense and determine the positions (open or closed) of the door 146. There can be one or more wireless transceivers 316 as a network connector for local wireless data networking connections. For example, there can be a wireless transceiver for local area working, referred to colloquially as WiFi. There can also be a wireless personal area network transceiver, such as those operating in accordance with the industry standard known as BlueTooth to allow connecting the sample randomizer to another device, such as a cellular telephone device. Further, the sample randomizer can include sample container identifiers, such as RFID readers 318. It will be appreciated that other forms of ID readers can be used equivalently, such as QR code or other optical code readers. The readers are used to identify the sample containers placed in the different holders 126 for the initialization process or to determine testing results.

Figure 4:
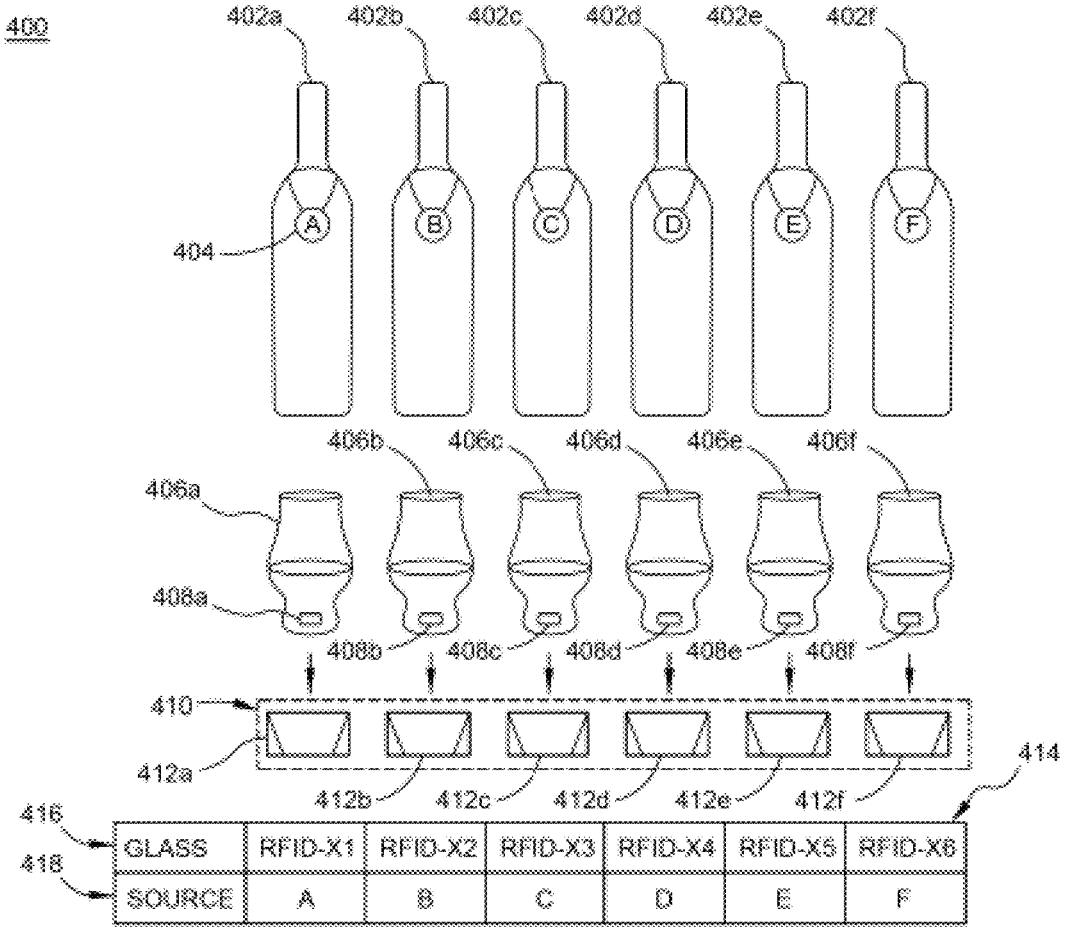
FIG. 4 shows a representation of an initialization process for associating source samples with specific sample holders, in accordance with some embodiments.

FIG. 4 shows a representation of an initialization process 400 for associating source samples 402*a*-402*f* with specific sample containers 406*a*-406*f*, in accordance with some embodiments. In the present example a single person is going to test six sources 402*a*-402*f*. First, each source can be identified with a medallion 404 with a letter A-F on it as an assigned identifier. Then liquid from each bottle 402*a*-402*f* is poured into its corresponding glass 406*a*-406*f*, which are the sample containers for the test. Each glass 406*a*-406*f* includes an RFID chip 408*a*-408*f* with a unique serial number in each RFID chip 408*a*-408*f*. The glasses can be placed in order into the initialization and ranking station 410, which includes the holders 126, which each have an RFID reader 412*a*-412*f* in them. Thus, source A 402*a* is poured into glass 406*a* and placed into the holder with RFID reader 412*a*. This is carried out for each of the sources 402*a*-402*f*, respectively into glasses 406*a*-406*f*, and placed into the holders with the corresponding RFID readers 412*a*-412*f*. The unique identifier of each RFID chip 408*a*-408*f* is read and provided to the processor 302. Knowing that the sample of source A 402*a* is placed in the position of reader 412*a*, assuming the user properly follows the instructions, the processor can then create a record associating the unique identifier of the RFID chip 408*a* with source A 402*a*. This is repeated for each source, and the processor 302 can create a record 414 in which each glass, as identified by its unique identifier, in row 416 is associated with a source in row 418. This allows the sample randomizer to determine which source is in the glass when the glass is placed in a random one of the holders 126; the RFID reader of that respective holder 126 will read the unique identifier and can use that to cross reference with the record 414 to determine which source is in the glass at that respective holder 126.

Figure 5:
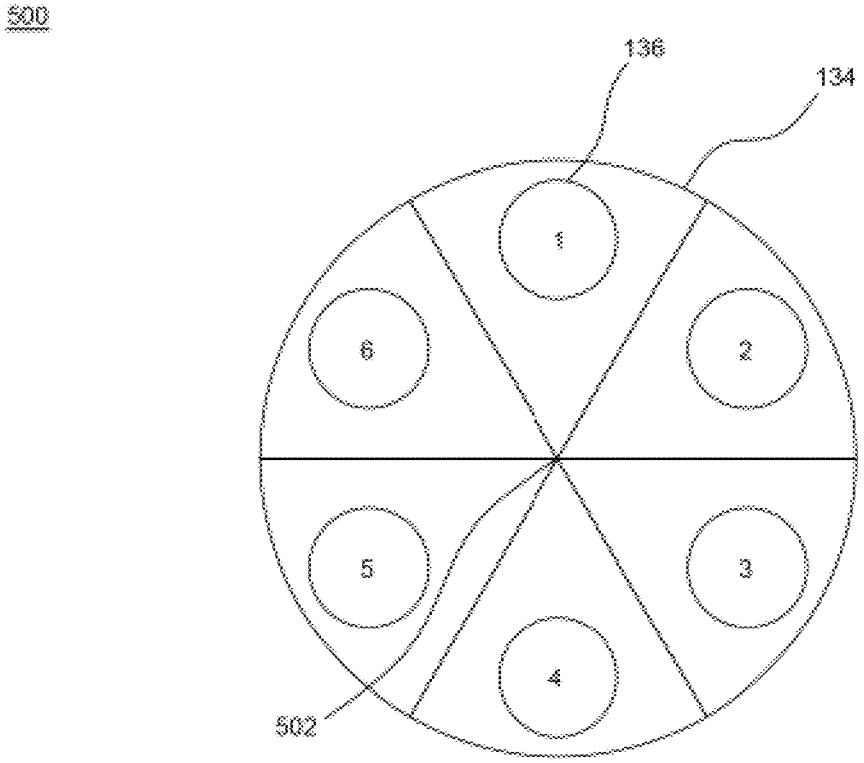
FIG. 5 shows a top plan view of a randomizing table used inside of a sample randomizer for blind testing, in accordance with some embodiment.

FIG. 5 shows a top plan view 500 of a randomizing table 134 used inside of a sample randomizer for blind testing, in accordance with some embodiment. The randomizing table has six positions numbered 1-6, and at each position there is a holder 136. The holders 136 can be referred to as table holders, while the holders 126 outside of the table can be referred to a ranking holders. The table is turned around its central point 502 by the stepper motor 130 so that a selected one of the positions 1-6 is presented at the opening 142 of the cover 140, depending on the operation being performed. The stepper motor 130 allows the processor to precisely control which table position 1-6 is located at the opening 142.

Figure 6:
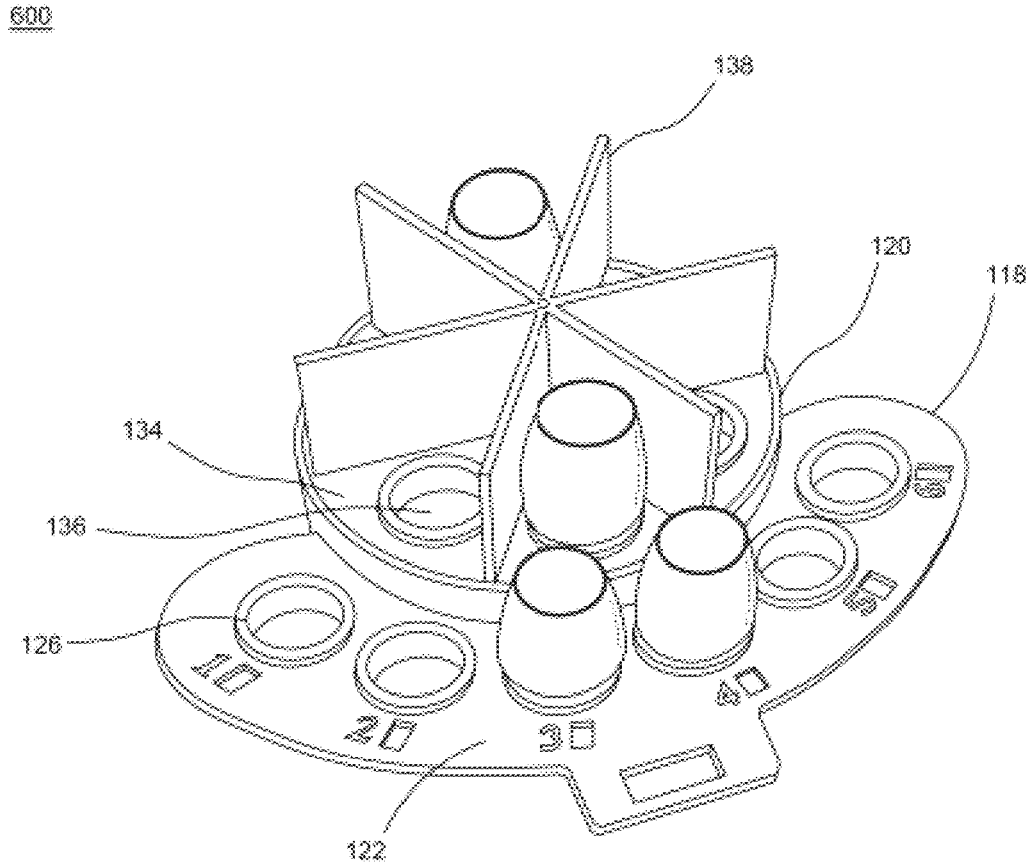
FIG. 6 shows a perspective view of a sample randomizer with the cover removed to expose the randomizing table during usage, in accordance with some embodiments.

FIG. 6 shows a perspective view 600 of a sample randomizer with the cover removed to expose the randomizing table during usage. This can represent either the loading process or the dispensing process. Several glasses (e.g.

406*a*-406*f*) are located in the ranking holders 126, while several of the glasses have been loaded into the table holders 136. The table 134 turns inside of the cowl 120 to turn a selected table position to the position of the opening in the cover. Then a glass can be placed into the table holder, or removed from the table holder, depending on which part of the process is being carried out, and as directed by the sample randomizer through, for example, prompts provided in the main display 116. As can be seen, the divider 138 prevents a user from seeing what is in the adjacent positions. The positions are unmarked as well to keep a user from tracking them.

Figure 7:
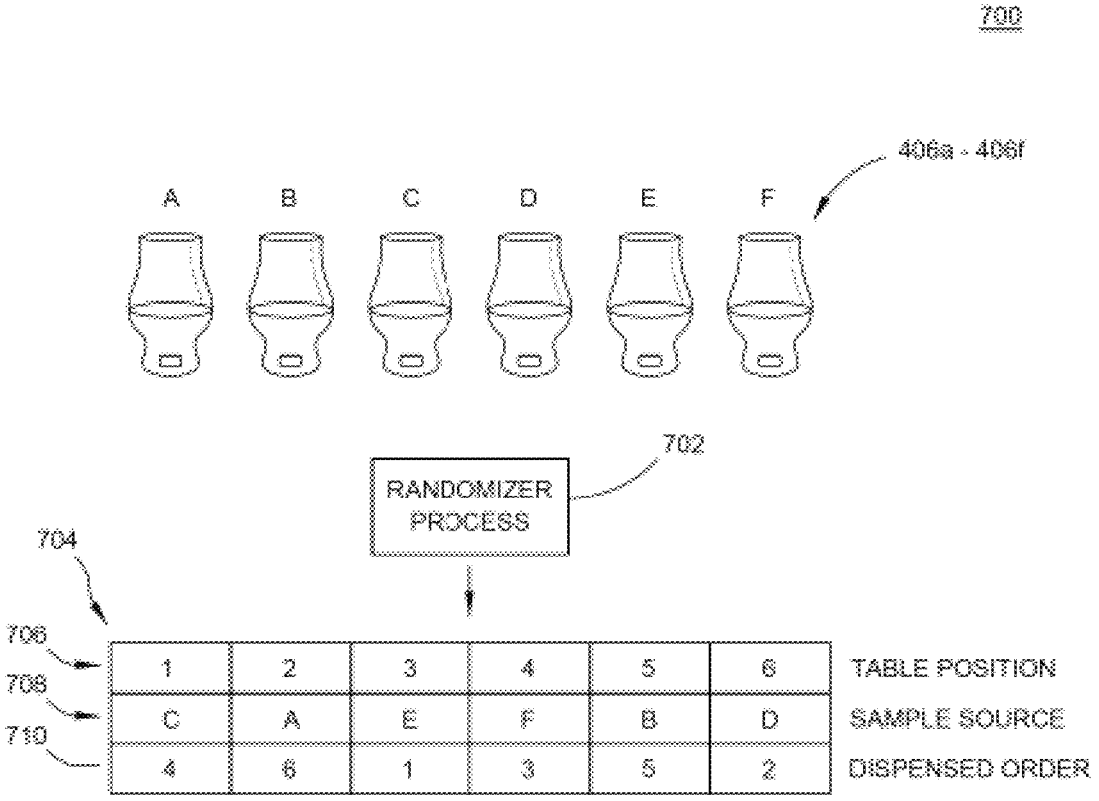
FIG. 7 shows a representation of a randomizing process, and how the sample randomizer keeps track of the samples, in accordance with some embodiments.

FIG. 7 shows a representation of a randomizing process 700, and how the sample randomizer keeps track of the samples, in accordance with some embodiments. As indicated in FIG. 4, the sample randomizer can create a record that associates samples with particular sample containers. That process is done in the ranking holders 126. As shown here sources A-F are poured into glasses 406*a*-406*f*, respectively. That is, there is a one-to-one correspondence, so that source A is in glass 406*a*, source B is in glass 406*b*, and so on. In addition, the glasses 406*a*-406*f* are located in ranking holders 126 at corresponding positions I-VI. So, glass 406*a* is in position I, glass 406*b* is position II, and so on. The glasses 406*a*-406*f* are then loaded into the table in order, from position I to position VI. A randomizer process 702 is carried out by the processor and used to turn the table 134 accordingly. A record 704 can be created and maintained in memory. The record 704 associates table positions 1-6 in row 706 with sources A-F, or glasses 406*a*-406*f* in row 708 based on their unique identifiers. These can be further associated with their dispensed order in row 710, which records a dispensed order indicator (e.g. 1-6) for each sample container, if desired. As a result, for example, the randomizer process randomly selects table position 2 to receive source A in glass 406*a*. The table is then turned so that table position 2 is at the opening. The user then opens the door and moves glass 406*a* from position I to the table, but the user does not know that the table position is table position 2 because the table position was randomly selected by randomizer process 702. The user then closes the door, which is sensed by the door sensor, and then the randomizer process selects the next table position to receive sample B in glass 406*b*. And as indicated in row 706 of the present example, table position 5 is selected. Then the user loads glass 406*b* into table position 5, again without knowing the table position. This continues until all of the glasses have been loaded. According to the present example, then, table position 1 holds source C, table position 2 holds source A, table position 3 holds source E, table position 4 holds source F, table position 5 holds source B, and table position 6 holds source D. At this point the samples are in random locations, and the user does not know which source is in a given table position. To further ensure randomization, the glasses/sources can be dispensed in a random order as well. Thus, as indicated in row 710, table position 3 is dispensed first. This means the randomizer process 702 randomly selected table position 3 to be dispensed first, and turns the table so that table position 3 is aligned with the opening. The user then opens the door and removes the sample, which happened to be source E. The user will not know which source is in the glass being removed. The user can place the removed glass in the next position of the ranking holders 126. The dispending process continues until all of the glasses/sources have been dispensed. The user can then test (e.g. taste) each sample and then re-position the glasses among the ranking holder positions I-VI. When the user is done and is satisfied with the ordering, the user can press a "finish" button (either a mechanical button or graphical button on a touch screen) and the sample randomizer will read the identifier of each glass at each ranking holder 126, perform the cross reference with record 414, and present the results showing which source is in each of the positions I-VI. A similar process can be done when multiple people are testing the sources, but then a different record line record 414 is needed for each person.

In some embodiments, there can be multiple users using the sample randomizer. The number of users can be, for example, an option that presented during an initialization process, and then selected. When multiple users are using the sample randomizer, the mapping record 704 can be divided into subsets, each subset corresponding to one of the users. For example, when two users are performing testing, the first three columns in the mapping record can be for a first user, and the second three columns can be for a second user. Rather than sources A-F, then, there may only be sources A-C (each of the two users will test the same three sources). In which case row 708 will repeat source identifiers A-C for table positions 4-6. Other mapping arrangements can be used for other numbers of users.

Figure 8:
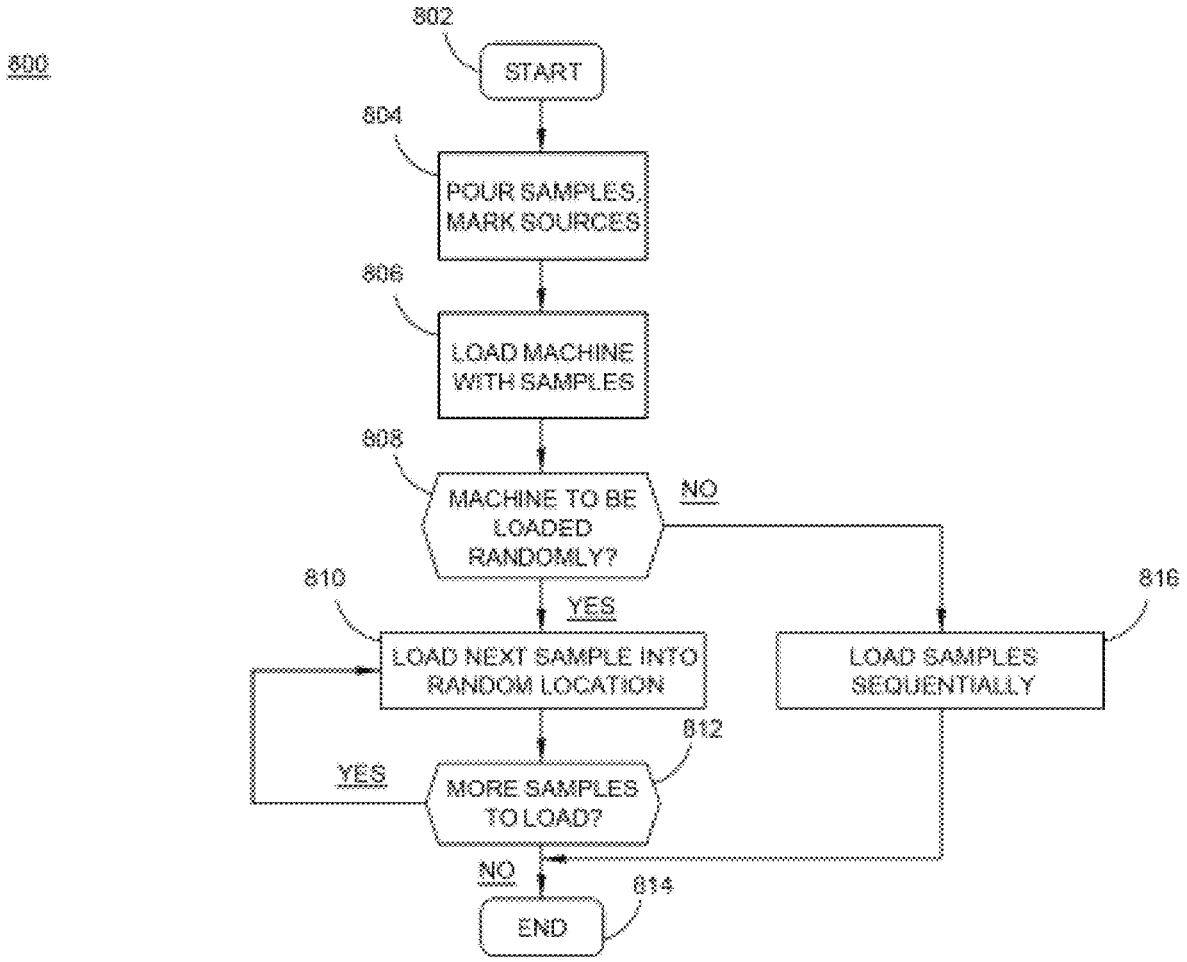
FIG. 8 shows a flow chart diagram of a general method of initializing and loading samples into a sample randomizer, in accordance with some embodiments.

FIG. 8 shows a flow chart diagram of a general method 800 of initializing and loading samples into a sample randomizer, in accordance with some embodiments. At the start 802 the user has collected several sources to be tested, along with sample containers (e.g. glasses with readable identifiers). In step 804 the user pours a portion of each sample into a respective one of the sample containers. The user must ensure that sources are identified such as by placing a medallion with one of the letters A-F on it in the source. Alternatively, the user may receive identified sources to be tested and the sources containers (e.g. bottles) can be marked only with designators A-F, respectively. This can allow, for example, libation makers to get blind feedback on various formulations of their product before deciding on one to take to market. As the sources are poured, the sample container are placed in order in the ranking holders so that the sample randomizer can create a record associating each source with a sample container. In step 806 the user can then begin to load the machine (e.g. the table), wherein the samples are loaded in a known order (e.g. based on source identifiers A-F). At step 808 the method can determine if the table is to be loaded randomly. If so then the method proceeds to step 810 where a random table location is selected and turned to the opening of the cover. The user then places the next sample container into the table holder exposed at the opening. This process continues until at step 812 it is determined that there are no more samples to load into the table, and the method ends at step 814. In some embodiments the randomization can be done only at the dispensing process, so from step 808 the method can proceed to step 816 in which the samples are loaded serially or sequentially into table positions. It will be appreciated that method 800 is meant to illustrate a high-level example of the actual method for loading a randomizer table and numerous variations can be devised consistent with the general operation of method 800.

Figure 9:
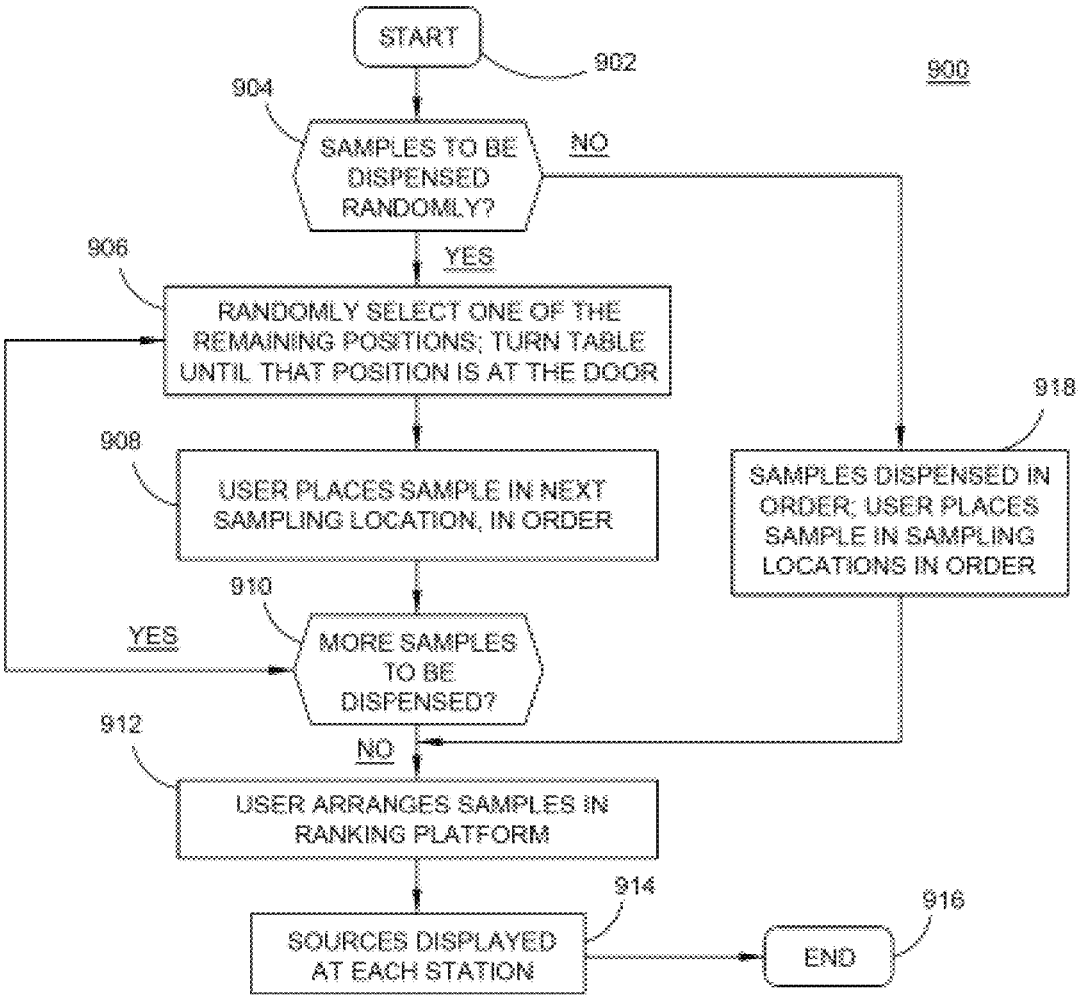
FIG. 9 shows a flow chart diagram of a general method for dispensing samples from a sample randomizer, in accordance with some embodiment.

FIG. 9 shows a flow chart diagram of a general method 900 for dispensing samples from a sample randomizer, in accordance with some embodiments. At the start 902, the sample randomizer is loaded, such as by performing a method consistent with method 800. The testing regimen can allow a user to select random dispensing in step 904, but at least one of method 800 or method 900 must be randomized, and at the user's option, both can be randomized. When randomized dispensing is selected, then in step 906 the sample randomizer randomly selects one of the table positions for dispensing and turns the table so that table position is aligned with the opening. The user, in step 908, can then open the door and remove the exposed sample container and place the sample container in the next available ranking position (or in any ranking position). This continues until in step 910 there are no more samples to be dispensed. Once all the samples have been dispensed, in step 912 the user tests the samples, and then places them in the user's preferred ranking order in the ranking holders. Then in step 914 the user can press a "finish" button, and the sample randomizer will read the identifier of each sample container at each ranking holder, perform a cross references to determine which source is in each ranking position, and display the results to the user. The method can then end in step 916. If the samples were randomized during the loading process, then the randomizing process during the dispending phase does not need to be performed, and from step 904 the method 900 can instead proceed to step 918 where the samples are dispensed in sequentially or otherwise non-randomly. Again, the method 900 is meant to show a high-level version of the dispensing process, and various details of implementation may vary while remaining consistent with this general method 900.

Figure 10:
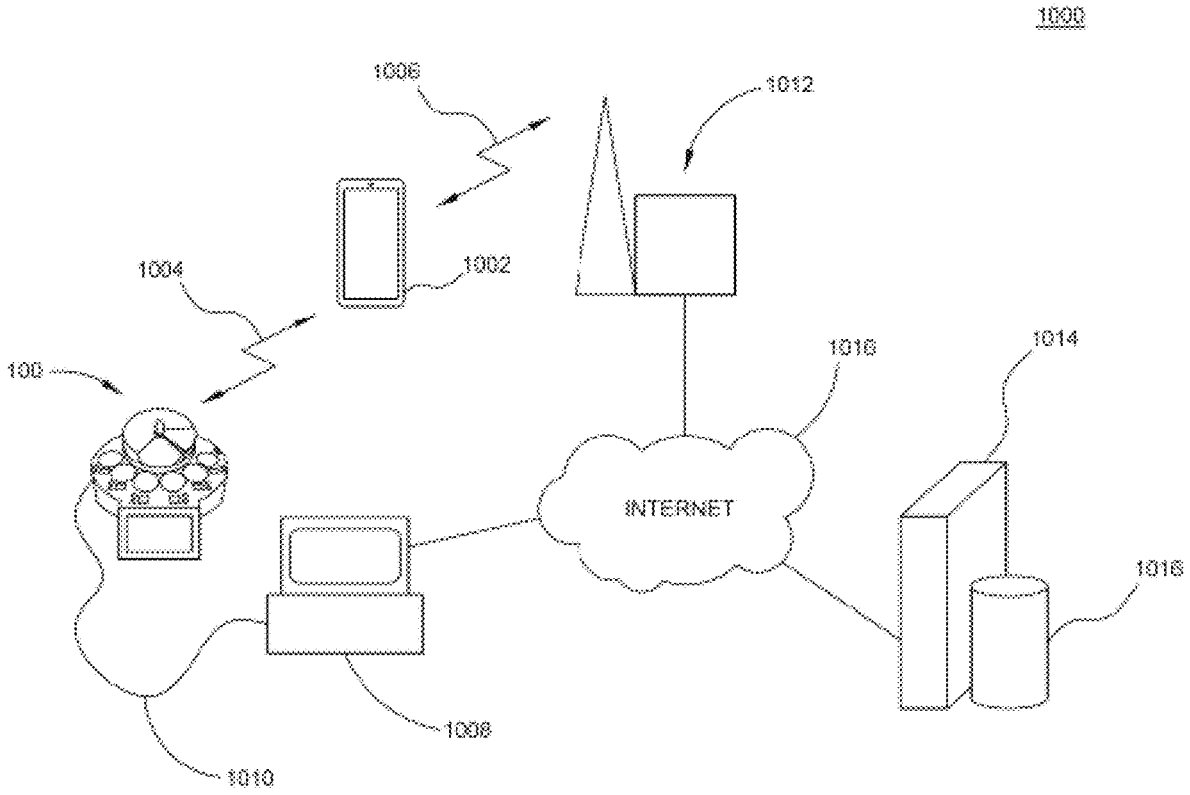
FIG. 10 shows a networked system in which a sample randomizer interfaces with a remote data center to carry out a prescribed sample testing regimen, in accordance with some embodiments.

FIG. 10 shows a networked system 1000 in which a sample randomizer 100 interfaces with a remote data center 1014 to carry out a prescribed sample testing regimen, in accordance with some embodiments. There are several use examples where such a networked implementation can be used. For example, a manufacturer (distiller, brewer, vintner, etc.) may send a sample set of sources, e.g. various formulations of spirit, beer, or wine, to a user as one of a large number of such users. The user can then test and rank the sources, and the results can be fed back to the data center 1014 for collection, and marketing analysis. In another use case, the user of the sample randomizer 100 can be a student seeking a recognition (e.g. certificate, degree) as a taste tester to become, for example, a sommelier. In order to do so, the student must prove proficiency in recognizing and distinguishing among various sources. In such a case, the data center 1014 can be run by a certifying authority. The student can receive a package of unidentified sources to test, and again, the results can be transmitted back to the data center for evaluation. In another use case, the user can simply be a hobbyist who tries various identified sources blindly, and can chose to share their preferences/results with the data center 1014 or simply have their data stored for their own use at the data center 1014. The data center 1014 can be coupled to a database 1016 to store data for subsequent use. The data center 1014 can be accessed by a general-purpose computer 1008 using a web browser to set up and access user accounts, as is well known.

The networking can be accomplished in several ways. For example, a cellular phone device 1002 can connect to the sample randomizer 100 via a BlueTooth link 1004. The cellular phone device 1002 can further connect to a cellular base station 1012 via a cellular data link 1006 (e.g. radio signals) to access the internet 1016 and the data center 1014. Alternatively, the general-purpose computer 1008 can be connected to the sample randomizer 100 such as by a universal serial bus (USB) cable. Both the cellular device 1002 and the general-purpose computer 1008 can run a suitable application program to conduct the communications with the sample randomizer 100, and the data center 1014.

Figure 11:
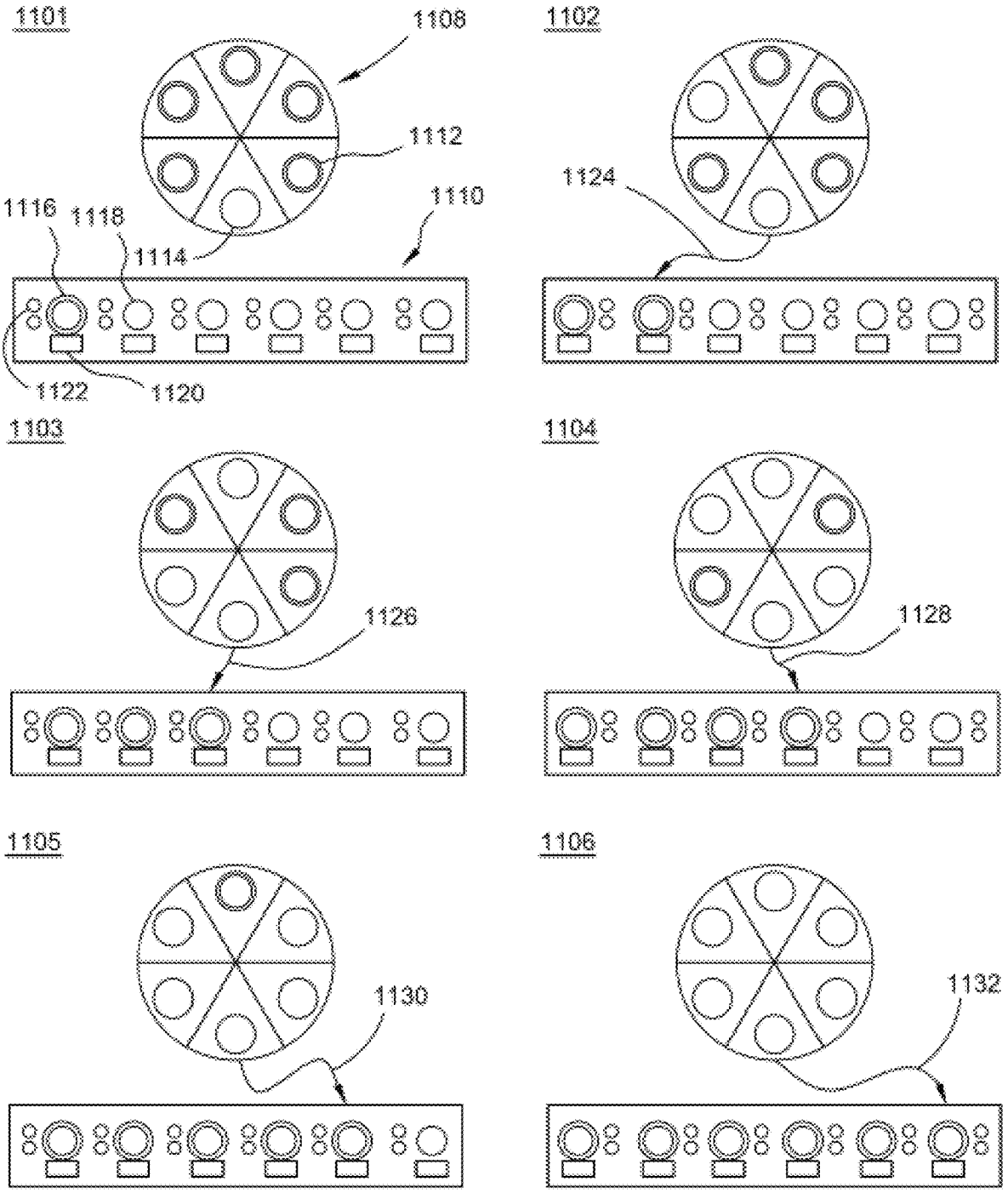
FIG. 11 shows a randomized dispensing sequence conducted by a sample randomizer, in accordance with some embodiments.

FIG. 11 shows a randomized dispensing sequence conducted by a sample randomizer, in accordance with some embodiments. In some embodiments, the sample containers do not need to have identifiers to identify them to the sample randomizer. Rather, as long as the user loads the sample randomizer in order of the sources A-F, and then places the dispensed samples in order on the ranking station, the sample randomizer can keep track of which sample is in each respective ranking position.

There are six sequence states 1101, 1102, 1103, 1104, 1105, and 1106 shown. In each of these states there is shown a randomizing table 1108 that has table holders, such as table holder 1114, for holding sample containers, such as sample container or glass 1112. There is also a tasting or ranking station 1110 in which there are six stations. Each station includes a station holder such as station holder 1118, a small display element 1120, and buttons 1122 which includes at least one input button. Through the sequence states 1101-1106 the sample containers on the randomizing table 1108 are dispensed in a random order, and placed sequentially in the station holders in a prescribed sequence (e.g. from left to right). Briefly, the dispensing process includes the sample randomizer, including the cover with a door (e.g. 140 and 146) being over the randomizing table, having mapped the sources to particular table positions, randomly selecting one of the remaining sample containers to be dispensed next and rotating the randomizing table 1108 so that the chose sample or table position is at the dispensing position. The user will then open the door (e.g. 146) to remove the exposed sample container, place the dispensed sample container on the next available ranking station position (e.g. in a station holder 1118), and then close the door. The door can also be closed before placing the sample container at the next ranking station. Once the user has closed the door and placed the dispensed sample container at the respective position, the user can then select "NEXT" at the display (not shown) or otherwise indicate to the sample randomizer to dispense the next sample, and the process is repeated. Thus, the sample containers are placed in the ranking positions in a known dispensed order.

Accordingly, at state 1101, the sample container 1116 is placed in the far-left ranking position, which is the first dispensed order position. In state 1102, the next dispensed sample is placed in the next ranking position, as indicated by arrow 1124. In state 1103, the next dispensed sample is placed in the next ranking position, as indicated by arrow 1126. In state 1104, the next dispensed sample is placed in the next ranking position, as indicated by arrow 1128. In state 1105, the next dispensed sample is placed in the next ranking position, as indicated by arrow 1130. In state 1106, the next dispensed sample is placed in the next ranking position, as indicated by arrow 1132. State 1106 is also the last sample to be dispensed, and all six of the samples are ready for testing. The user at this point should not know which source is at any given position, assuming physical differences between the samples aren't observed (e.g. the samples all appear the same or the sample containers prevent visual observation of the samples).

It should be noted that randomization can occur during the dispensing process, as indicated here. For example, in state 1101, one sample has been dispensed, leaving five samples on the randomizing table 1108. From state 1101 to state 1102, the randomizing table has been rotated effectively clockwise by two positions. From state 1102 to state 1103 the randomizing table has been rotated effectively clockwise by one position of the randomizing table. From state 1103 to state 1104, the randomizing table 1108 has been effectively rotated clockwise two positions. From state 1104 to state 1105 the randomizing table 1108 has been effectively rotated clockwise two positions (or counter-clockwise one position). From state 1105 to state 1106 the randomizing table 1108 has been effectively rotated clockwise (or counter-clockwise) three positions. For each of these, the table can be rotated one or more full revolutions before the final partial rotation to dispense a sample. During this time the sample randomizer is tracking in its memory which samples have been dispensed, so that only remaining samples can be selected for dispensing.

FIG. 12A shows a user ranking of randomized samples placed in the ranking station of a sample randomizer, in accordance with some embodiments. Sample containers 1116*a*-1116*f* are placed in positions I-VI in a respective station holder (e.g. 1118), as would be the case at state 1106 of FIG. 11. As shown here, however, the user has given each sample a rank after testing all of the samples. The rank can be a number, such as 1-6, indicating the user's preference as shown here. Alternatively, the user can indicate which source the user believes the sample came from, as a test of the user's ability to blindly identify the source of each sample. For example, the user can operate the buttons 1122*a*, 1122*f* at each respective position I-VI to select a ranking or source identifier, which is then displayed on the corresponding display element 1120*a*-1120*f*. In FIG. 12B, the source of each sample is revealed, such as by pressing a "finish" button or the equivalent. When the user presses the "finish" button the system can check to maker sure there are no duplicate entries for rankings. As shown here, the sample at the first position "I" is from source "C," and was given a ranking of "2." The sample at the second position "II" is from source "B," and was giving a ranking of "6." The sample at the third position "III" is from source "E," and was giving a ranking of "3." The sample at the fourth position "IV" is from source "D," and was giving a ranking of "1." The sample at the fifth position "V" is from source "A," and was giving a ranking of "5." The sample at the sixth position "VI" is from source "F," and was giving a ranking of "4." These results can be stored locally for the user to review later, and/or the results can be stored remotely, in a cloud account. In some embodiments, the results can be sent to a certifying authority to indicate how accurately the user was able to identify the sources from the blind testing of the samples.

Figure 13:
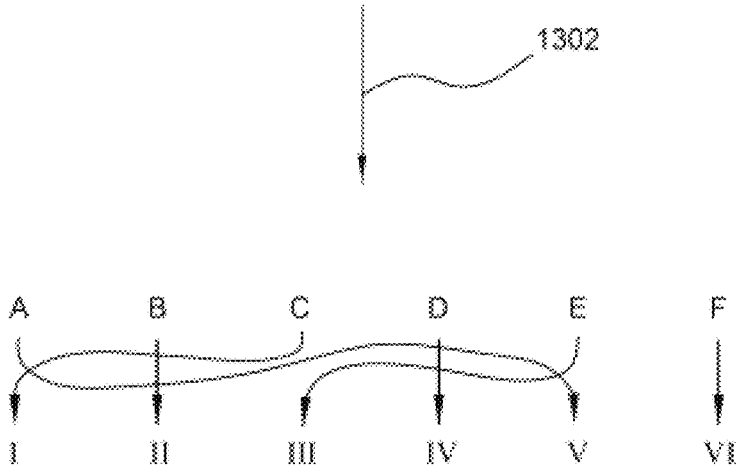
FIG. 13 shows a mapping of the memory table of FIG. 12C to the tasting positions for revealing the source of each sample at the respective tasting positions, in accordance with some embodiments.

FIG. 12C shows a memory table data structure used by a sample randomizer to track which source sample was dispensed to each respective tasting position of the sample randomizer. The sources A-F are identified in the "SOURCE" row, their position on the randomizing table is identified in the "TABLE POSITION" row, and the order in which they were dispensed, which is randomly selected in this example, is identified in the "DISPENSED POSITION" row. As indicated, the loading of the randomizing table in this example was not randomized since sources A-F are loaded sequentially in table positions 1-6, but the dispensing is randomized. Alternatively, as indicated hereinabove, the loading can instead be randomized, or both the loading and the dispensing can be randomized. The memory structure will track the samples accordingly, allowing the source to be mapped to a dispensed position, as indicted in FIG. 13. Arrow 1302 indicates the mapping of sources to positions after the randomizing process. This allows the sample randomizer to display the source at the display element 1120*a*-1120*f* of each position I-VI. Of course, it will be appreciated that a different randomized order will result in a different mapping.

There are a variety of applications for the inventive sample randomizer. in general, for a sample randomizer using six positions, there can be source identifier to identify each of six different sources. These source identifiers can be labeled A through F, and can take the form of necklaces or charms that can be placed on the source bottles. In some embodiments the source identifiers can be clips that clip onto the packaging of each source material. The source identifiers ensure proper identification and seamless randomization throughout the testing.

One application can involve a ranking challenges, which allows users to rank the sources being tested based on personal preference, from most to least favored. For example, when the sources are material that is tested by taste, after tasting and assigning a ranking to each sample, the sample randomizer can reveal the source identifiers for each sample, letting users compare their rankings of the tested samples.

In another application users can attempt to identify each sample by analyzing, for example, its appearance, aroma, and flavor. The sample randomizer maps user selections to the actual samples so that the user can see which samples the user correctly identified, and which sample were not correctly identified, thereby providing feedback on the user's accuracy in identifying the sources from blind testing.

To facilitate these various applications, the inventive sample randomizer randomizes the dispensing of sample container while maintaining their corresponding labels (A-F) in memory for later mapping to the user's ranking or identification answer. Sample containers are loaded individually into one of six respective positions on the randomizing table, which is separated by internal walls to keep each sample hidden. A concealing cover ensures that only one glass is accessible at a time, making the testing process controlled and unbiased.

The randomizing process involves placing or loading the sample containers into randomly selected positions of the randomizing table, selecting random ones of the remaining samples on the randomizing table to be dispensed next in the dispensing process, or both randomization processes be used. In the dispensing process, the sample containers are transferred to the ranking stations, where users will rank or attempt to identify the samples. The sample containers can be arranged in specific positions on the platform, in a prescribed order to ensure that the sample randomizer can track the samples. The ranking stations can include LED displays with a two-digit LED display so that both the user's selection (rank or sample source choice) and the actual source can be displayed, providing real-time feedback for rankings or identification attempts. To facilitate entry of rankings, there can be buttons at each position to allow a user to cycle through the available choices and then indicate a selection as final.

The removable cover is placed over the randomizing table to conceal the sample container during randomization. A sliding door allows the user to load or unload one sample container at a time, ensuring the challenge remains fair and the sample containers stay hidden from view until they are dispensed for testing in an order that is tracked, and mapped by the sample randomizer to the user's rankings or identity choices.

the sample randomizer can include a main graphic display that can be a touch screen display, and which serves as the starting point for all tasting challenges and provides quick access to user management options. The user can set up and initiate tests and challenges, including indicating how many users are participating, and how many samples are being evaluated. It is also contemplated that the sample randomizer can include a library of sources (e.g. names of wines/spirits, vintage, etc.) to allow a user to identify how many times the user can accurately identify the source. It is further contemplated that the user can enter source information to augment or add to the library, or create their own library in the memory of the sample randomizer, in a cloud account via the sample randomizer.

the sample randomizer can be used in association with a cloud account that is accessible via a web portal. The web portal can allow users to create personalized challenge rooms in which other users are invited to participate. These rooms allow users to set up custom tasting experiences for a ranking challenge or an identity challenge. Within the challenge room, users can specify various parameters including the number of participants, the number of samples/beverages, and the specific sources for the challenge. This function is useful for sommelier Programs in which instructors can create predefined challenges to test students' tasting skills. The challenge room function is also useful for beverage producers as it allows them to gather valuable consumer feedback on new products through blind tasting events.

The sample randomizer can store sample evaluation templates, or access sample evaluation templates from a remote server/data center. For example, libation evaluation templates can be provided to capture essential tasting attributes like appearance, nose, palate, finish, and origin. These templates can be used during a sampling, prompting the user to provide input for each category, which is then stored are part of a record. This can help users organize their notes, using a combination of predefined options and professional-level questions, especially for wine and whiskey/bourbon tastings. The easy-to-use interface allows users to record detailed sensory observations. Users interact with these templates through intuitive combo boxes and checkboxes, making it easy to record observations and conduct a structured, professional-grade tasting.

There is provided a NEXT button, either as an electromechanical button, touch sensor, or radio button on a touch display, which acts as a cue for users to communicate to the device that they are prepared to move forward to the next stage of the process. Essentially, it serves as a confirmation from the user that they are poised to progress further in the process.

There can also be, in some embodiments, a SEE RESULTS button which finalizes the tasting challenge by displaying the user's rankings or identification results. In a Ranking Challenge, it organizes the samples based on user preference, while in an Identity Challenge, it compares user selections against the source identities. If more than two (per participate) identity selections are incorrect, the user can be prompted to try again or reveal the results. Once confirmed, the results can be uploaded to the server for tracking and future reference.

Exemplary Process—Libation Testing of Several Different Wines or Spirits

Step 1: Assign Variables and Prepare Glasses

User(s) begins by assigning a unique variable (A-F) to the bottle of each sample bottle being used for the challenge. Next, pour each of the sampled into one of up to six glasses (Glencairn or the provided stemless Riedel glasses) with the corresponding beverages. Attach the Alphabet Necklace Charms (A-F) to the neck of each bottle to ensure proper identification throughout the tasting process. Finally, place the Removable Concealing Cover over the spinning platform to ensure the samples remain hidden during randomization.

Step 2: Power On the Device

Turn on the Device:

The main LED display can show: "Welcome! Press 'Let's Begin' to start the tasting challenge."

Step 2.1: Wi-Fi Connection Setup)

Once you press 'Let's Begin', the device will guide you through the following steps:

Automatic Wi-Fi Detection: The device will attempt to establish a Wi-Fi connection automatically. If a connection is successful, proceed directly to Step 2.2.

No Internet Connection Detected:

If no connection is detected, the screen will display: "No internet connection detected. Select 'Set Up Network' to connect or 'Skip' to proceed in Offline Mode."

Option 1: Set Up Network & Login

Select 'Set Up Network' to locate and connect to a Wi-Fi network.

The device will display available networks. Select your Wi-Fi and enter the password if prompted.

Once connected, the device will proceed to Step 2.2.

Note: If connection fails, the message "Connection failed. Try again or select 'Skip' to proceed in Offline Mode." will appear.

Step 2.2: Account Setup

Once connected to Wi-Fi, the user will be prompted with: "Login, Create New Account, or Skip to proceed in Offline Mode."

Create New Account:

Login: If the user selects 'Login', they can enter their credentials

Logged-In Benefits:

Track and save tasting results.

Receive firmware updates.

Access Custom Challenges.

Option 2: Skip. If the User Selects 'Skip', the Device Will Proceed Directly to Step 3 in Offline Mode. Note: In Offline Mode, Features Like Result Tracking and Firmware Updates Will be Unavailable. Core Tasting Functions Remain Fully Operational.

Step 3: Select Your Libation (Home Screen)

Once setup is complete, the device will display: "Please select the type of libation for your tasting challenge."

Available Options:

Wine

Whiskey/Bourbon

Beer

Other (e.g., Vodka, Tequila, Rum, etc.)

Custom Challenge (for fully personalized tasting experiences)

User Name Display:

The current user's name will be shown in the top-right corner, with the option to:

Change User: Quickly switch to a different profile.

If operating in Offline Mode, it will display 'Offline Mode' with option to Login Step 3.1: Custom Challenge Selected If the device is in Offline Mode, the screen will display: "This feature is not available in Offline Mode. Please login to use the Custom Challenge feature."

Custom Challenge (Logged In):

If the user is logged in, the device will display:

"Enter the Custom Challenge Room Number."

The user will enter the room number generated on the accompanying website.

Once the room number is entered, the device will load the personalized challenge specifications.

Note: Custom Challenge is designed for fully personalized tasting experiences created through the website.

Step 4: Select Libation Type and Participants

After selecting the libation type (Wine, Whiskey/Bourbon, Beer, or Other), the device will display the following prompt:

"How many participants will be joining the tasting challenge?"

Available Options

1 Participant—Choose between 2 to 6 samples to taste.

2 Participants—Choose 2 or 3 samples per participant.

3 Participants—Each participant will have 2 samples.

Reset and Return Home Functionality

From this point forward, the RESET AND RETURN HOME button will be available on all screens.

This feature allows users to reset the device and return to the Home Screen at any time.

Button Behavior

When selected, a confirmation message will appear: "Are you sure you want to reset and return to the Home Screen? Please ensure all samples are removed from the device before proceeding."

Button Options

Selecting YES will reset the device and return the user to the Home Screen. Any unsaved progress will be lost.

Selecting NO will return to the current screen, allowing the user to continue where they left off.

Step 5: Choose Your Challenge Type

The device will display: "What type of tasting challenge would you like to conduct?"

Available Options

Ranking Challenge: Display Message "Rank your favorites from best to worst (blind ranking)."

Identity Challenge (1 participant): Display Message "Make educated choices to match each sample to its correct variable (A-F) based on appearance, aroma, and flavor."

Identity Challenge (more than 1 participant): Display Message "Make educated choices to match each sample to its correct variable (A-F) based on appearance, aroma, and flavor-compete to see who assigns the most correctly!"

Step 5.1: Choose Tasting Mode

If more than one participant is selected, the device will present the following two options:

TASTESYNC—A synchronized blind tasting where all participants taste the same sample at the same time, in a shared random order. This mode fosters collective discussion and group exploration.

TASTEMIX—A true randomized blind tasting where participants receive the same set of samples, but the order of the samples is completely randomized for each person. This mode encourages unique, personal impressions and individual preferences.

Step 6: Specify Number of Samples for the Challenge

The device will display: "How many samples will be included in the challenge?"

Options Based on Number of Participants:

For 1 Participant: Available options: 2, 3, 4, 5, or 6 samples.

For 2 Participants: Available options: 2 or 3 samples per participant.

For 3 Participants: Available option: 2 samples per participant

Guided User Experience: The device will dynamically adjust the available options based on the number of participants selected in Step 4.

Step 7: Select Beverages for Each Sample

In this step, the user selects the name of the beverages being used for the challenge from a built-in library. The options available will depend on the libation type selected in step 3, and the number of beverages specified in step 6.

Instructions for Step 7

Display Variables: The screen will display the variables A-F (based on the number of samples chosen in Step 6).

Select a Variable: When the user presses a variable (e.g., A), a drop-down menu will appear with a library of options based on the selected libation type. The user can scroll through and select a beverage name from the list.

"Other" Option: If the desired beverage is not in the library, the user can select "Other" and manually type in the name of the beverage.

Buttons Available

Skip: The user can skip assigning names and proceed with only the variables (A-F) for the challenge.

Next: Once all variables have a selection (from the library or manually entered), the user presses Next to proceed.

Error Handling: If the user presses Next without selecting names for all variables, the screen will display a message: "A & B are missing a selection. Please choose from the library or skip to proceed." This ensures the user addresses incomplete entries before advancing.

Step 8: Place Sample Glasses on the Tasting Station

After selecting the names of the samples, the 14-segment LEDs located beneath each socket on the Tasting Station will light up, displaying the corresponding letters (A-F). The screen will prompt: "Please place the sample glasses on their associated letters on the Tasting Station and press 'Next' when completed."

Instructions and Dynamic LED Assignments

The letters A-F will be displayed dynamically, based on the number of participants and samples selected.

The device guides users through proper placement as follows:

For a Single Participant

If there are 6 Samples: LEDs A, B, C, D, E, F will light up for positions I, II, III, IV, V, VI.

If there are 5 Samples: LEDs A, B, C, D, E will light up for positions I, II, III, IV, V.

If there are 4 Samples: LEDs A, B, C, D will light up for positions I, II, III, IV.

If there are 3 Samples: LEDs A, B, C will light up for positions I, II, III.

If there are 2 Samples: LEDs A, B will light up for positions I, II.

For 2 Participants

If there are 3 Samples:

LEDs for A, B, C will light on positions I, II, III for Participant 1.

LEDs for A, B, C will light on positions IV, V, VI for Participant 2.

If there are 2 Samples:

LEDs for A, B will light on positions II, III for Participant 1.

LEDs for A, B will light on positions IV, V for Participant 2.

For 3 Participants

There are 2 Samples:

LEDs for A, B will light on positions I and II for Participant 1.

LEDs for A, B will light on positions III and IV for Participant 2.

LEDs for A, B will light on positions V and VI for Participant 3.

Visual Guidance

The display will include an animated graphic showing sample glasses being placed on the corresponding sockets, aligned with the LED letters.

If more than 1 participant is selected, the graphic will also highlight the designated placement for each participant on the Tasting Station.

The screen will guide users the socket position, participant, and libation variable for placement Step 9: Load Glasses Sequentially with Randomized Spinning After pressing "Next," the device will guide users step-by-step through the process of loading glasses onto the spinning platform. To enhance randomization, the platform will alternate between clockwise and counterclockwise rotations after each glass is loaded.

Step-by-Step Process

Initial Prompt: the device displays "Load Glass A into the Loading Socket. Press 'Next' when completed."

For multiple participants, the message adjusts to: "Participant 1: Load Glass A into the Loading Socket. Press 'Next' when completed."

Visual Guidance

The A segment LED also flashes an upward-facing arrow to indicate the correct variable.

All other sockets remain idle to avoid confusion.

An animated graphic on the screen will visually demonstrate moving the glass from the numbered position on the Tasting Platform to the Loading Socket.

Loading Process

User places Glass A to the Loading Socket.

User presses "Next" to confirm.

Randomized Spinning

After confirming, the spinning platform will rotate in a random direction (clockwise or counterclockwise).

Once the platform stops, the next socket is illuminated, and the device prompts:

"Load Glass B into the Loading Socket. Press 'Next' when completed."

The B segment LED flashes, and the animated graphic updates to show the new position.

For Multiple Participants

The device alternates prompts between participants as needed. For example:

Participant 1: "Load Glass A."

Participant 2: "Load Glass A."

Participant 3: "Load Glass A."

After completing Glass A for all participants, the sequence continues with Glass B, and so on.

Completion

The process repeats until all glasses are loaded for all participants.

Final Randomization

After the final glass is loaded and the user presses "Next," the device will display:

"Finalizing the randomization process—please wait!"

The spinning platform will proceed to spin clockwise and counterclockwise for additional randomization. This process will continue for 5 seconds before moving to the next step.

Step 10: Transfer Glasses to the Ranking Platform

After the final randomization spin, the device will guide users step-by-step to unload each glass from the spinning platform to the Tasting Platform, which is numbered from 1 to 6 (left to right) using Roman Numerals. This ensures proper organization for the tasting challenge.

Detailed Instructions

Initial Prompt: For a single participant, the Main LED will display "Move the glass from the Loading Socket to Position I on the Tasting Platform. Press 'Next' when done." For multiple participants, the message adjusts to: "Participant 1—Move the glass from the Loading Socket to Position I on the Tasting Platform. Press 'Next' when done."

Visual Guidance

On the Tasting Platform, the target position (e.g., Position I) will display a flashing upward facing arrow on the 2-digit segment LED.

An animated graphic on the screen will visually demonstrate moving the glass from the loading socket to the correct numbered position on the Tasting Platform.

Unloading Process

The user removes the glass from the Loading Socket on the spinning platform.

Place the glass in the indicated numbered position (e.g., Position I) on the Tasting Platform.

Press "Next" to confirm.

Incremental Progression

After pressing "Next," the spinning platform will rotate to bring the next glass to the Loading Socket.

The Main LED will update to the next prompt, such as: "Move the glass from the Loading Socket to Position II on the Tasting Platform. Press 'Next' when done." This process will continue sequentially until all glasses have been unloaded to Positions I through VI.

For Multiple Participants

The unloading process alternates between participants, with instructions adjusted based on their assigned positions on the Tasting Platform. The positions are numbered I to VI, moving from left to right. Each participant is allocated specific positions:

Participant 1: Positions I and II

Participant 2: Positions III and IV

Participant 3: Positions V and VI

Example Instructions for Unloading

Participant 1: "Move the glass from the Loading Socket to Position I on the Tasting Platform."

Participant 2: "Move the glass from the Loading Socket to Position III on the Tasting Platform."

Participant 3: "Move the glass from the Loading Socket to Position V on the Tasting Platform."

Once all participants have unloaded their glasses to their assigned positions, the process continues with the second sample, repeating the sequence until all samples have been unloaded.

Completion

Once all glasses have been unloaded, the device will display one of the following messages based on the challenge type selected in Step 5:

For Ranking Challenge: "All glasses have been successfully unloaded. Please proceed to taste and rank your selections."

For Identity Challenge: "All glasses have been successfully unloaded. Please proceed to taste and infer your selections."

Step 11: Conduct the Tasting and Record Results

This is the most interactive and robust step, where participants conduct their tasting, rank their preferences, or infer the identity of the libations. Detailed and intuitive instructions ensure an organized and enjoyable experience.

Detailed Instructions

Conducting the Tasting

Each participant interacts with the Tasting Platform, using the two momentary buttons located to the left of each 2-digit LED display to either rank or infer their preferences based on the challenge type selected in Step 5:

Ranking Challenge: Participants assign a ranking number (1-6).

Identity Challenge: Participants identify the libation by selecting a variable (A-F).

Completing the Libation Evaluation Templates

Templates Overview: For Whiskey/Bourbon or Wine, participants complete a Libation Evaluation Template, capturing Appearance, Nose, Palate, Finish, and Origin using the provided options displayed on the screen.

Interactive Input

Select the Roman Numeral position (I-VI) corresponding to each sample on the Tasting Platform.

For Multiple Participants

Participant 1: Positions I and II.

Participant 2: Positions III and IV.

Participant 3: Positions V and VI.

Each position's details are recorded individually.

Use combo boxes and checkboxes to select attributes for each sample.

Exceptions: If "Other" was selected in Step 3, this feature is nullified for now (future iterations will expand this functionality to additional libations like beer or vodka).

Error Handling Missing Entries

If a participant presses "See Results" before completing their rankings or Identities:

(X=Variable for Roman Numeral)

For Ranking: The device will display, "Please rank Position X to proceed."

For Identity: The device will display, "Please infer Position X to proceed."

For Ranking: If multiple positions are missing, the message will include all (e.g., "Please rank Positions I, III, and IV to proceed.")

For Identity: If multiple positions are missing, the message will include all (e.g., "Please infer Positions I, III, and IV to proceed.")

The Results button will remain disabled until all required fields are completed.

Avoiding Duplicates

Ranking Challenge

If a participant assigns the same ranking number (e.g., "3") to multiple positions, the device will flash a warning on the LED and display:

"Duplicate detected in positions X and X Please correct to proceed."

Identity Challenge

If a participant selects the same variable (e.g., "A") for multiple positions, the device will flash a warning on the LED and display:

"Duplicate variable detected in positions X and X. Please correct to proceed."

Duplicate entries disable the Results button until corrected.

Missing Template Values

If Libation Evaluation Templates are incomplete and the user presses "See Results":

The device will prompt: "Position X is missing values for Libation Evaluation Templates, press Yes to proceed with Results or No to Return."

If multiple templates are incomplete, the message will adjust accordingly (e.g., "Positions X and X are missing values, press Yes to proceed with Results or No to Return.")

If yes is selected, incomplete templates will be omitted, and results will display without those entries.

If No is selected, the user is returned to the current screen to complete missing templates.

Custom Challenge Rooms

If marked as mandatory, completing the Libation Evaluation Templates must be completed to proceed.

If missing, the device will read "Position X is missing values for Libation Evaluation Templates and must be completed to proceed."

Corresponding Positions on 2-Digit LED

The numbered 2-digit 14-segment LEDs (1-6) on the Tasting Platform remain active throughout this step, ensuring participants can easily match their glasses to the on-screen prompts.

The left digit will display the user's selection options, which vary based on the number of participants and challenge type. For example, in a Ranking Challenge with 6 participants, each user can choose only 1 or 2, while in an Identity Challenge, the options are limited to A or B.

The right digit displays the final ranking in Ranking Challenges or the selected variable in Identity Challenges once the user presses "See Results."

Participant Scenarios

For 1 Participant:

Minimum 2 samples, maximum 6 samples.

Rankings range from 1 to 6, or variables from A-F.

For 2 Participants:

Minimum 2 samples, maximum 3 samples.

Participants alternate positions (e.g., Participant 1 uses positions I, II, and III; Participant 2 uses positions IV, V, and VI).

For 3 Participants:

Limited to 2 samples.

Positions are divided as follows:

Participant 1: Positions I and II.

Participant 2: Positions III and IV.

Participant 3: Positions V and VI.

Step 12: Viewing and Interpreting Results

After completing the tasting process and pressing "See Results," the device will display the final results based on the selected challenge type—Ranking Challenge or Identity Challenge. This step provides a detailed breakdown of the tasting results, offering insights and feedback for the user(s).

Results Display Process

Upon pressing "See Results," the device presents the results in an organized format based on the number of participants and the selected challenge type:

For a single participant, the results will be displayed as a single summary covering all samples.

For multiple participants the results will be grouped by participant, clearly showing each individual's tasting data.

Ranking Challenge Results: The screen will display a Ranking Summary, showing the socket position (I-VI), the libation name (from Step 7, if selected), the ranking order assigned by the user, from most to least favored.

Identity Challenge Results: The screen will display an Identity Summary, showing the socket position (I-VI), the user's inferred selection, the actual correct result, the accuracy percentage.

Handling Errors and Incomplete Entries. If any required inputs are missing before displaying results, the device will prompt the user:

Ranking Challenge. If positions are missing rankings, the device will display "Please rank Position I to proceed." If multiple positions are incomplete, the device will list them, displaying "Please rank Position I, III, and V to proceed."

Identity Challenge. If positions are missing Identity selections the display can say "Please infer Position I to proceed." If multiple identities are incomplete, it will adjust the message to "Please infer Position II and IV to proceed."

Multiple Attempts

If a participant has more than two incorrect identities, the device will prompt "Oops! You have two or more incorrect Identities. You can press 'See Results' to view the correct answers, or press 'Try Again' to adjust your selections." If there are only two samples per participant (e.g., for three participants), the 'Try Again' option will not be available since there is only one possible selection per sample. For two participants, if one participant has two or more incorrect Identities, the device will prompt specifically for that participant: "Oops! Participant 1—You have two or more incorrect Identities. You can: press 'See Results' to view the correct answers, or press 'Try Again' to adjust your selections."

Corresponding Positions and LED Indicators

The Tasting Platform positions (I-VI) remain illuminated throughout the result review phase to help users match their samples with the displayed results.

The left digit of the 2-digit 14-segment LED continues to represent the user's selection, while the right digit displays the ranking or Identity result value.

Saving and Uploading Results

Once results are displayed, if logged in, the device will automatically upload the results to the user profile for future tracking and analysis. If in offline mode, results are stored temporarily but cannot be saved to an online profile. A summary screen will appear with the message "Results successfully uploaded to your profile," if logged in, or "results available for review until Returned to Home or device is powered off," if in offline mode.

Next Steps After Viewing Results

After reviewing the results, users will have the following option: "Start New Challenge"—Returns to the Home Screen to begin a new tasting session.

Overall Usage

The sample randomizer conducts ranking or blind tasting challenges by randomizing the placement of up to six beverage samples and guiding users through a structured tasting process. Users assign variables (A-F) to their samples, which are randomized on a spinning platform. The device then directs users to transfer the samples to a tasting station, where they can rank or infer the identity of each beverage using intuitive LED displays and controls. Preloaded sensory options allow users to capture tasting notes and smells during the process. Results are displayed alongside randomized variables, enabling users to track their performance and refine their tasting skills. Designed for both individual and shared challenges, the device supports multiuser functionality and integrates Wi-Fi for saving data, accessing updates, and participating in group challenges via room IDs.

Key Benefits and Outcomes of the Sample randomizer: it provides an engaging, social, and competitive experience.

Rank and Infer Your Libations:

The device allows enthusiasts to engage in ranking or inferring their favorite libations, while also tracking results for future reference. Whether you're alone or with friends, the device transforms a simple tasting session into a fun, competitive experience.

Group Challenges for Up to 3 Participants: You can enjoy the challenge with up to 3 friends, enhancing the experience by introducing friendly competition. Participants go head-to-head in an Identity challenge, testing their ability to identify libations, or they can reveal their favorite libations through the ranking challenge, making the experience both competitive and social. This taps into the growing trend of shared experiences and fosters social interaction.

Data-Driven Insights for Brands and Distributors

Consumer Preferences and Market Trends: As a data collection tool, the device allows for tracking users' true preferences in ranking challenges, offering valuable insights. For example, while a particular brand may dominate sales, consumer preference data could reveal that another brand is a favorite, providing powerful market data that brands and distributors can use for decision-making.

Behavioral Data for Product Development: Beverage producers and distributors can leverage the device's data to gain insights into consumer preferences, helping them refine product offerings and improve marketing strategies. This positions Sample randomizer as an indispensable tool for brand differentiation and market intelligence.

A Powerful Educational Tool

Sommelier and Tasting Education: The device is an invaluable resource for sommelier programs and wine schools. Instructors can set up customized challenges to evaluate students' abilities to identify and rank libations under blind tasting conditions, providing structured learning and assessment.

Customized Challenge Rooms: Distillers and producers can use these challenge rooms for real-time consumer feedback. By conducting blind taste tests in a controlled setting, they can gauge how new products perform in comparison to existing ones, receiving actionable feedback on consumer preferences. This makes the device a perfect fit for product development and market research in the beverage industry.

Enhanced Consumer Engagement and Community Building

Online Community and User Interaction: The device's integration with online platforms allows users to connect, share experiences, and compare results. Users can join online forums where they discuss their favorite libations, share tasting notes, and earn badges from successful Identity challenges. This creates a community-driven ecosystem, which can lead to brand loyalty and user engagement. Badges and Achievements: By incorporating gamification, the device motivates users to keep improving their tasting skills. The earned badges, which users can proudly display, provide an added incentive for regular use, creating a sense of accomplishment and fostering long-term engagement.

Standards for Data Collection in the Libation Industry

Reliable Consumer Data: As the device gathers data from real-world users, it becomes a trusted source of unbiased consumer preference information. Brands can use this data to gain a clearer picture of what their customers actually enjoy, offering personalized recommendations and adjusting product lines based on true consumer tastes rather than market assumptions.

Targeted Marketing and Product Placement: By tracking the most preferred libations across various categories, beverage companies can better target their marketing efforts and fine-tune product placements. For distributors, the device offers a valuable opportunity to suggest products that rank highly among consumers, boosting sales and market share.

Scalability and Future-Proof Technology

Online Integration and Customization: The accompanying website, which allows users to create personalized challenge rooms, ensures the device evolves with the market. The ability to customize challenges for different beverages or participant levels keeps the device relevant for a wide range of industries, from wine enthusiasts to spirits producers.

The claims appended hereto are meant to cover all modifications and changes within the scope and spirit of the present invention.

What is claimed is:

1. A sample randomizer, comprising:

a base;

a table positioned in the base that is rotatable, the table includes a plurality of defined sample positions in which a plurality of sample containers can be placed;

a cover that is configured to fit onto the base and conceal the table, a door provided on the cover that is configured to expose a single one of the defined sample positions on the table when opened;

a controller;

wherein, upon the table being loaded with the plurality of sample containers, the plurality of sample containers are then dispensed by the sample randomizer in a randomized order selected by the controller;

a memory, coupled to the controller, in which a mapping of a source of each one of the plurality of sample containers is mapped by the controller to the randomized order in which the plurality of sample containers are dispensed; and a ranking station including a plurality of ranking positions in which the plurality of sample containers are placed upon being dispensed; each ranking position having at least one input button and a display, wherein, at each ranking position of the plurality of ranking positions, the at least one input button is configured to receive a user input indicating one of a ranking or an identity, and wherein the display is configured to display the user input and the source corresponding to the sample container based on the mapping.

2. The sample randomizer of claim 1, further comprising a separator wall that sits on the table and separates the plurality of sample positions from each other, and which is covered by the cover when the cover is placed over the table.

3. The sample randomizer of claim 1, further comprising a main display that is positioned at a front of the sample randomizer and which is configured as a touch screen.

4. The sample randomizer of claim 1, wherein the table has six defined sample positions.

5. The sample randomizer of claim 1, wherein the mapping maps a plurality of sets of sources for a respective plurality of users.

6. The sample randomizer of claim 1, further comprising a door sensor that indicates whether the door is open or closed.

7. The sample randomizer of claim 1, further comprising a network connector to operably connect the controller to a remote server.

* * * * *